US011223910B2

(12) United States Patent
Hillbratt et al.

(10) Patent No.: US 11,223,910 B2
(45) Date of Patent: Jan. 11, 2022

(54) ALGORITHM AND WEARING OPTION INTERACTION WITH A VIBRATORY PROSTHESIS

(71) Applicant: Cochlear Limited, Macquarie University (AU)

(72) Inventors: Martin Evert Gustaf Hillbratt, Mölnlycke (SE); Kristian Gunnar Asnes, Mölnlycke (SE)

(73) Assignee: Cochlear Limited, Macquarie University (AU)

( * ) Notice: Subject to any disclaimer, the term of this patent is extended or adjusted under 35 U.S.C. 154(b) by 800 days.

(21) Appl. No.: 15/471,484

(22) Filed: Mar. 28, 2017

(65) Prior Publication Data

US 2017/0289706 A1 Oct. 5, 2017

Related U.S. Application Data

(60) Provisional application No. 62/314,594, filed on Mar. 29, 2016.

(51) Int. Cl.
*H04R 25/00* (2006.01)

(52) U.S. Cl.
CPC ..... *H04R 25/453* (2013.01); *H04R 25/305* (2013.01); *H04R 25/356* (2013.01); *H04R 25/505* (2013.01); *H04R 2460/13* (2013.01)

(58) Field of Classification Search
CPC ..... H04R 2460/13; H04R 25/505; H04R 25/558; H04R 25/606; H04R 2225/41; H04R 2225/67; H04R 25/356; H04R 25/453; H04R 2225/43; H04R 2225/55; H04R 2225/63; H04R 25/70; G06F 3/015; G06F 3/016; G06F 3/0487; G06F 3/167; G08B 7/06; G10L 2015/223; G10L 25/84
USPC ..... 600/25; 381/326, 315, 312, 317, 322, 381/23.1
See application file for complete search history.

(56) References Cited

U.S. PATENT DOCUMENTS

2007/0027676 A1* 2/2007 Chambers ..... A61N 1/36036 704/200.1
2008/0002849 A1 1/2008 Tan
2011/0103613 A1* 5/2011 Van Der Werf ..... H04R 25/453 381/93
2012/0082329 A1* 4/2012 Neumeyer ..... H04R 25/65 381/314
2012/0290045 A1* 11/2012 Nicolai ..... A61N 1/36036 607/57
2013/0064404 A1* 3/2013 Ridler ..... H04R 25/405 381/313
2013/0188796 A1* 7/2013 Kristensen ..... H04R 25/453 381/60

(Continued)

FOREIGN PATENT DOCUMENTS

EP 0581261 A1 * 2/1994 ..... H04R 25/453

*Primary Examiner* — Alexander Krzystan
*Assistant Examiner* — Julie X Dang
(74) *Attorney, Agent, or Firm* — Pilloff Passino & Cosenza LLP; Martin J. Cosenza

(57) ABSTRACT

A method, including the actions of obtaining data based on a current and/or anticipated future wearing implementation of a hearing prosthesis, and adjusting a parameter of the hearing prosthesis based on the current or anticipated future wearing implementation of the hearing prosthesis, and evoking a hearing percept using the hearing prosthesis with the adjusted parameter.

20 Claims, 18 Drawing Sheets

(56) References Cited

U.S. PATENT DOCUMENTS

| | | | | |
|---|---|---|---|---|
| 2013/0204325 | A1* | 8/2013 | Botros | H04R 25/70 607/57 |
| 2013/0245363 | A1* | 9/2013 | Johansson | H04R 25/606 600/25 |
| 2014/0039576 | A1* | 2/2014 | Hillbratt | H04R 25/505 607/57 |
| 2014/0050341 | A1 | 2/2014 | Flynn et al. | |
| 2014/0275732 | A1 | 9/2014 | Hillbralt et al. | |
| 2014/0330160 | A1* | 11/2014 | Sohn, II | A61B 5/065 600/559 |
| 2014/0355801 | A1* | 12/2014 | Goorevich | H04R 25/554 381/315 |
| 2014/0364681 | A1* | 12/2014 | Hillbratt | H04R 25/453 600/25 |
| 2015/0230036 | A1* | 8/2015 | Pedersen | H04R 25/505 381/330 |

* cited by examiner

ALGORITHM AND WEARING OPTION INTERACTION WITH A VIBRATORY PROSTHESIS

CROSS-REFERENCE TO RELATED APPLICATIONS

This application claims priority to Provisional U.S. Patent Application No. 62/314,594, entitled ALGORITHM AND WEARING OPTION INTERACTION WITH A VIBRATORY PROSTHESIS, filed on Mar. 29, 2016, naming Martin Evert Gustaf HILLBRATT of Molnlycke, Sweden as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. In some instances, bone conduction devices can be used to treat single side deafness, where the bone conduction device is attached to the mastoid bone on the contra lateral side of the head from the functioning "ear" and transmission of the vibrations is transferred through the skull bone to the functioning ear. Bone conduction devices can be used, in some instances, to address pure conductive losses (faults on the pathway towards the cochlea) or mixed hearing losses (faults on the pathway in combination with moderate sensorineural hearing loss in the cochlea).

SUMMARY

In accordance with one aspect, there is a method, comprising obtaining data based on a current and/or anticipated future wearing implementation of a hearing prosthesis and adjusting a parameter of the hearing prosthesis based on the current or anticipated future wearing implementation of the hearing prosthesis, and evoking a hearing percept using the hearing prosthesis with the adjusted parameter.

In accordance with another aspect, there is a method, comprising evoking a hearing percept in a recipient via a hearing prosthesis set at a first setting and subsequently obtaining data based on a current and/or anticipated future setting of the hearing prosthesis that influences performance of the hearing prosthesis, wherein the current and/or future anticipated setting is different from the first setting relocating at least a portion of the hearing prosthesis, relative to a body of the recipient of the hearing prosthesis, from a location of the portion of the hearing prosthesis where the hearing percept was evoked at the first setting, based on the obtained data.

In accordance with another aspect, there is a device, comprising a hearing prosthesis configured such that an operating parameter thereof is adjustable to account for a change in a location of at least a portion of the sound capture device relative to a recipient of the hearing prosthesis.

BRIEF DESCRIPTION OF THE DRAWINGS

Some embodiments are described below with reference to the attached drawings, in which.

DETAILED DESCRIPTION

Some and/or all embodiments of the technologies detailed herein by way of example and not by way of limitation can have utilitarian value when applied to various hearing prostheses. Two such exemplary hearing prostheses will first be described in the context of the human auditory system, followed by a description of some of the embodiments.

Figure 1A:
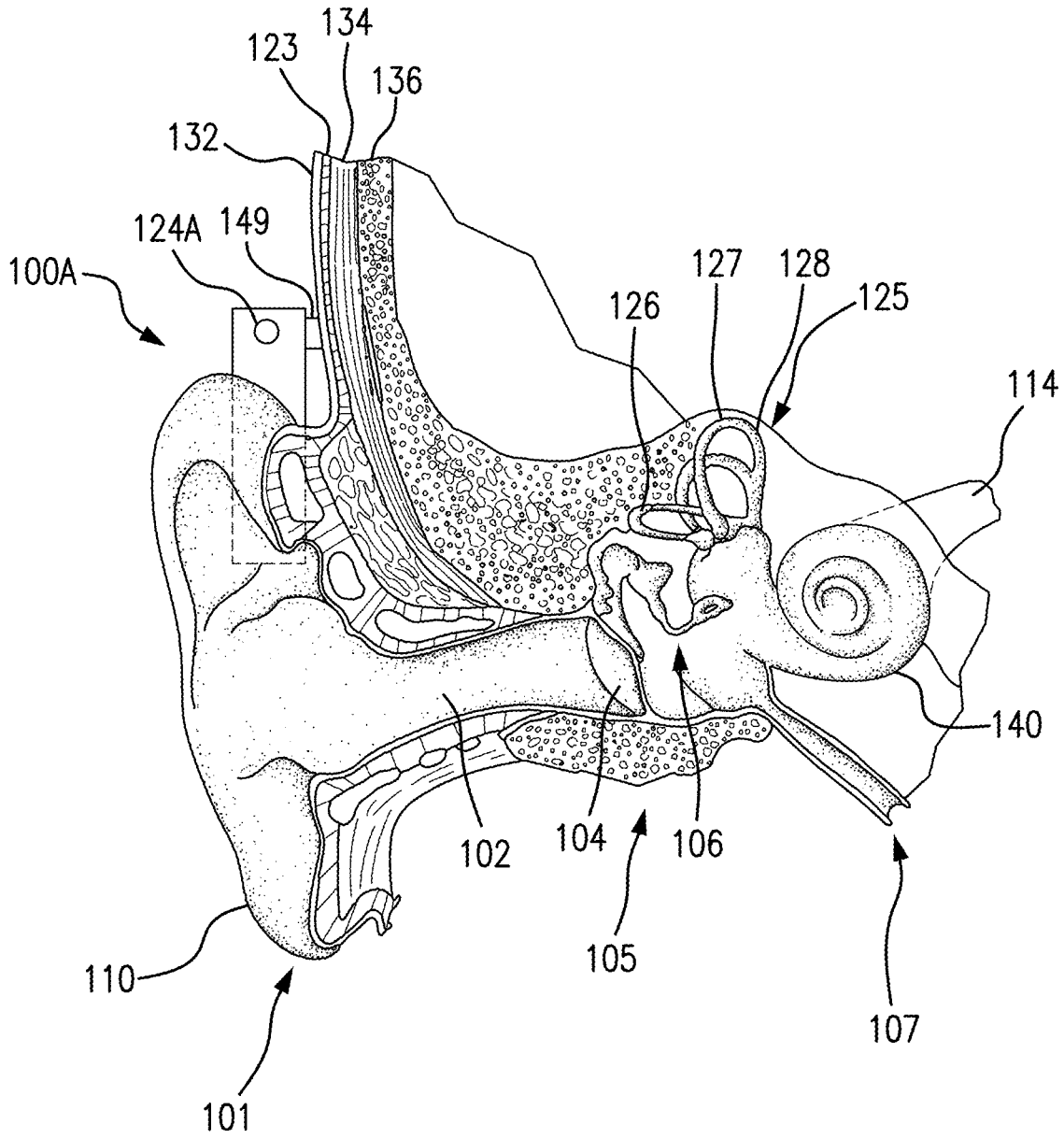
FIG. 1A is a perspective view of an exemplary bone conduction device.

FIG. 1A is a perspective view of a bone conduction device 100A. As shown, the recipient has an outer ear 101 including ear canal 102, a middle ear 105 where the tympanic membrane 104 separates the two, and an inner ear 107. Some elements of outer ear 101, middle ear 105 and inner ear 107 are described below, followed by a description of bone conduction device 100.

FIG. 1A also illustrates the positioning of bone conduction device 100A relative to outer ear 101, middle ear 105 and inner ear 103 of a recipient of device 100. As shown, bone conduction device 100A is positioned behind outer ear 101 of the recipient and comprises a sound capture element 124A to receive sound signals. Sound capture element may comprise, for example, a microphone, telecoil, etc. Sound capture element 124A can be located, for example, on or in bone conduction device 100A, or on a cable extending from bone conduction device 100A. While not shown in FIG. 1A, the bone conduction device 100A can include an additional microphone that can be alternately used instead of or in addition to microphone 124A.

Bone conduction device 100A can comprise an operationally removable component (which is an external component) and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 124A. In this regard, the operationally removable component is sometimes referred to herein as a vibrator unit and/or an actuator. More particularly, sound input device 124A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 149 configured to operationally removably attach the operationally removable component to a bone conduction implant (also referred to as an anchor system and/or a fixation system) which is implanted in the recipient. With respect to FIG. 1A, coupling assembly 149 is coupled to the bone conduction implant (not shown) implanted in the recipient in a manner that is further detailed below with respect to exemplary bone conduction implants. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
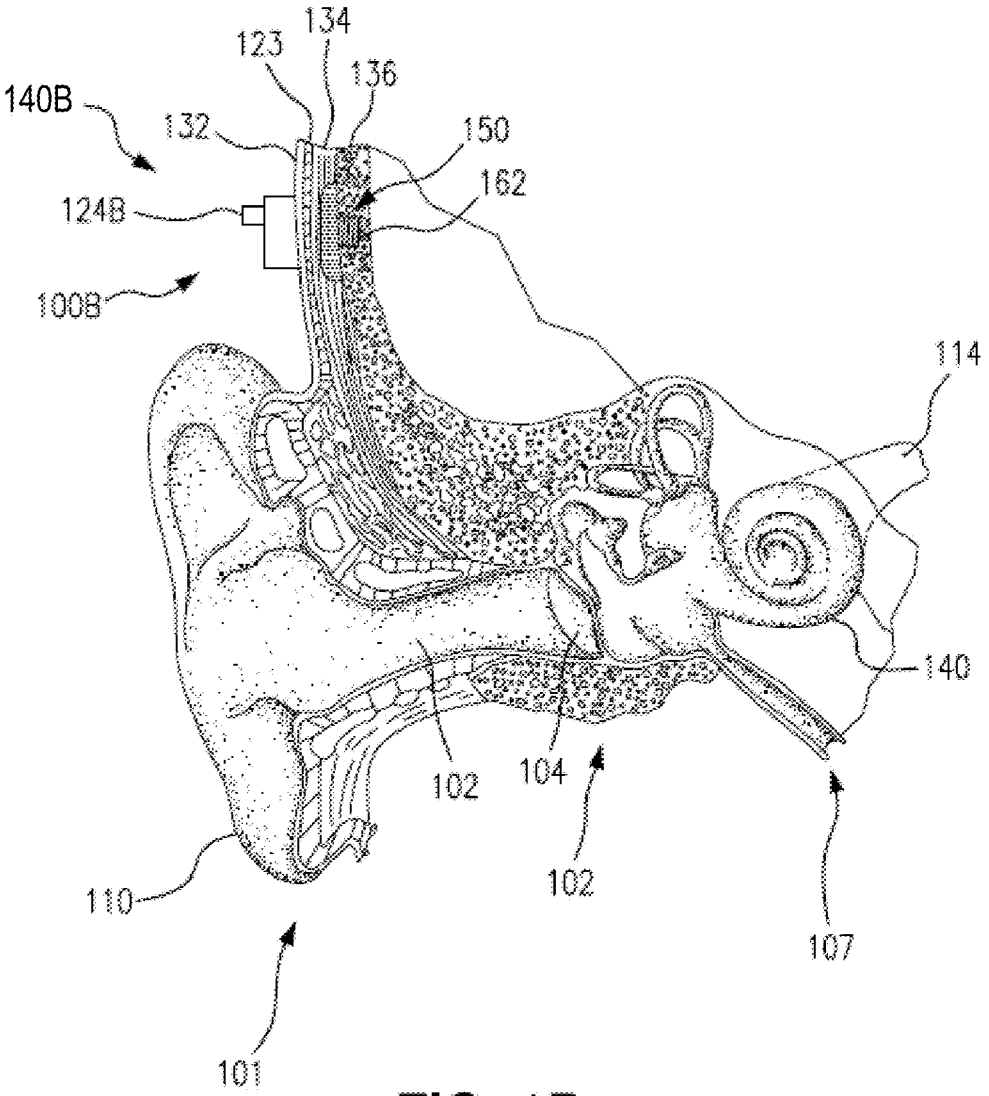
FIG. 1B is a perspective view of an alternate exemplary bone conduction device.

More specifically, FIG. 1B is a perspective view of a transcutaneous bone conduction device 100B.

FIG. 1B also illustrates the positioning of bone conduction device 100B relative to outer ear 101, middle ear 105 and inner ear 107 of a recipient of device 100. As shown, bone conduction device 100B is positioned behind outer ear 101 of the recipient. Bone conduction device 100B comprises an external component 140B and implantable component 150. The bone conduction device 100B includes a sound capture element 124B to receive sound signals. As with sound capture element 124A, sound capture element 124B may comprise, for example, a microphone, telecoil, etc. Sound capture element 124B may be located, for example, on or in bone conduction device 100B, on a cable or tube extending from bone conduction device 100B, etc.

Bone conduction device 100B comprises a sound processor (not shown), an actuator (also not shown) and/or various other operational components. In operation, sound capture element 124B converts received sounds into electrical signals. These electrical signals are utilized by the sound processor to generate control signals that cause the actuator to vibrate. In other words, the actuator converts the electrical signals into mechanical vibrations for delivery to the recipient's skull.

A fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2A:
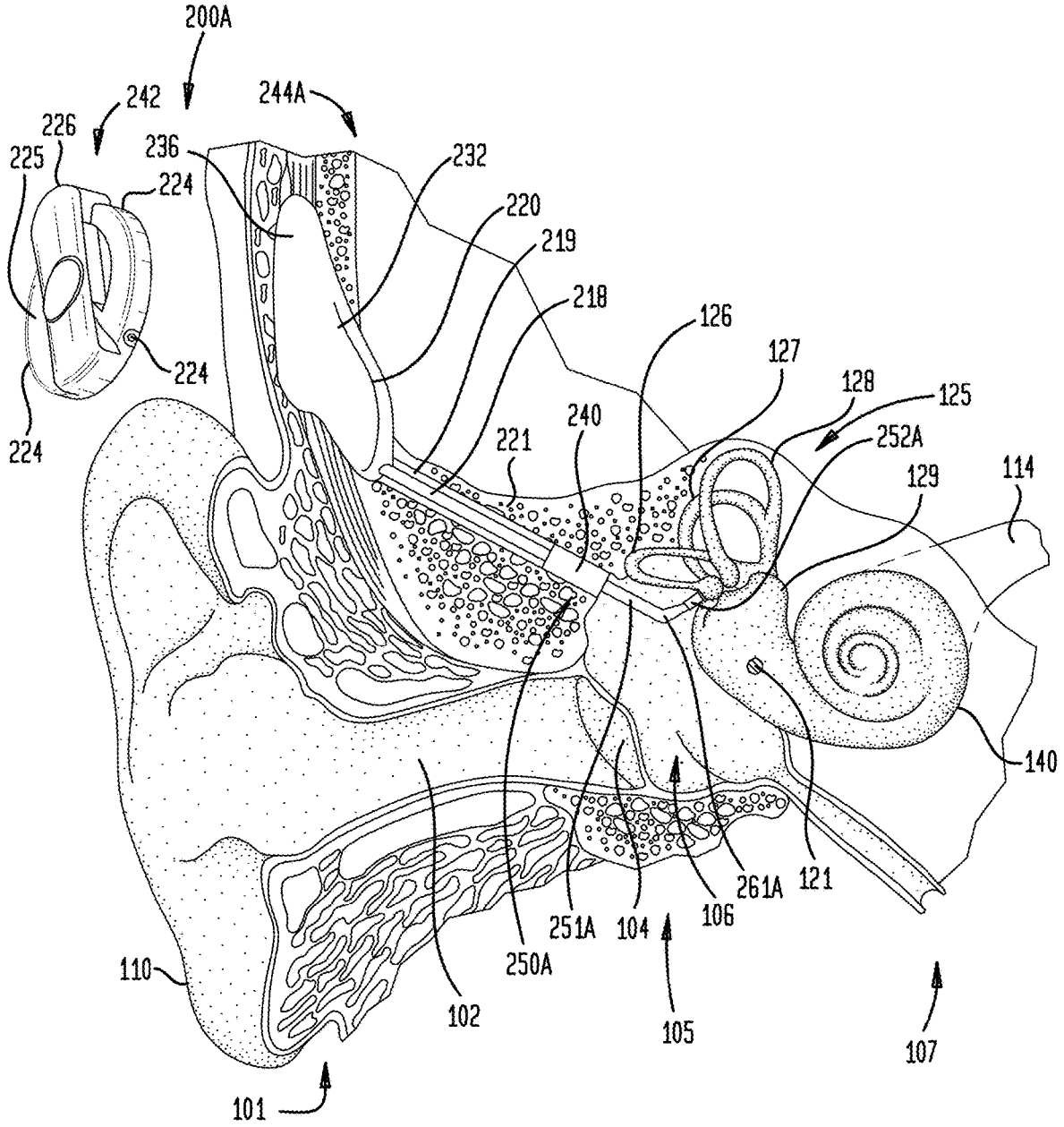
FIG. 2A is a perspective view of an exemplary direct acoustic cochlear implant (DACI) implanted.

FIG. 2A is a perspective view of an exemplary direct acoustic cochlear implant (DACI) 200A. DACI 200A comprises an external component 242 that is directly or indirectly attached to the body of the recipient, and an internal component 244A that is temporarily or permanently implanted in the recipient. External component 242 typically comprises two or more sound capture elements, such as microphones 224, for detecting sound, a sound processing unit 226, a power source (not shown), and an external transmitter unit 225. External transmitter unit 225 comprises an external coil (not shown). Sound processing unit 226 processes the output of microphones 224 and generates encoded data signals which are provided to external transmitter unit 225. For ease of illustration, sound processing unit 226 is shown detached from the recipient.

Internal component 244A comprises an internal receiver unit 232, a stimulator unit 220, and a stimulation arrangement 250A in electrical communication with stimulator unit 220 via cable 218 extending thorough artificial passageway 219 in mastoid bone 221. Internal receiver unit 232 and stimulator unit 220 are hermetically sealed within a biocompatible housing, and are sometimes collectively referred to as a stimulator/receiver unit.

In FIG. 2A, ossicles 106 have been explanted. However, it should be appreciated that stimulation arrangement 250A may be implanted without disturbing ossicles 106.

Stimulation arrangement 250A comprises an actuator 240, a stapes prosthesis 252A and a coupling element 251A which includes an artificial incus 261B. Actuator 240 is osseointegrated to mastoid bone 221, or more particularly, to the interior of artificial passageway 219 formed in mastoid bone 221.

In FIG. 2A, stimulation arrangement 250A is implanted and/or configured such that a portion of stapes prosthesis 252A abuts an opening in one of the semicircular canals 125. For example, stapes prosthesis 252A abuts an opening in horizontal semicircular canal 126. In some alternative regimes, stimulation arrangement 250A is implanted such that stapes prosthesis 252A abuts an opening in posterior semicircular canal 127 or superior semicircular canal 128.

As noted above, a sound signal is received by microphone(s) 224, processed by sound processing unit 226, and transmitted as encoded data signals to internal receiver 232. Based on these received signals, stimulator unit 220 generates drive signals which cause actuation of actuator 240. The mechanical motion of actuator 240 is transferred to stapes prosthesis 252A such that a wave of fluid motion is generated in horizontal semicircular canal 126. Because, vestibule 129 provides fluid communication between the semicircular canals 125 and the median canal, the wave of fluid motion continues into median canal, thereby activating the hair cells of the organ of Corti. Activation of the hair cells causes appropriate nerve impulses to be generated and transferred through the spiral ganglion cells (not shown) and auditory nerve 114 to cause a hearing percept in the brain.

Figure 2B:
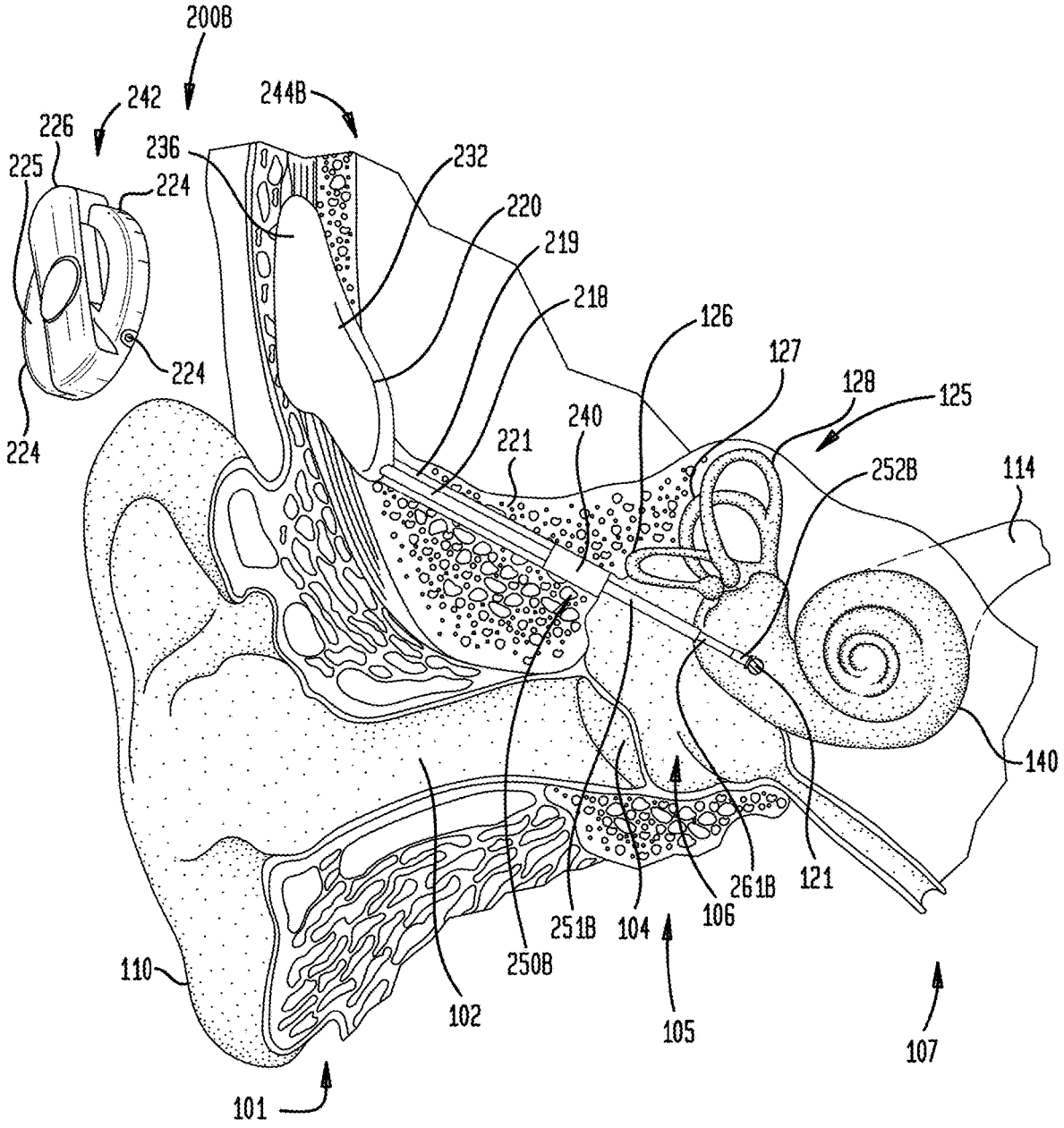
FIG. 2B is a perspective view of another exemplary DACI implanted in a recipient.

FIG. 2B is a perspective view of another type of DACI. DACI 200B comprises external component 242 and an internal component 244B.

Stimulation arrangement 250B comprises actuator 240, a stapes prosthesis 252B and a coupling element 251B which includes artificial incus 261B which couples the actuator to the stapes prosthesis. Here, stimulation arrangement 250B is implanted and/or configured such that a portion of stapes prosthesis 252B abuts round window 121 of cochlea 140.

Figure 2C:
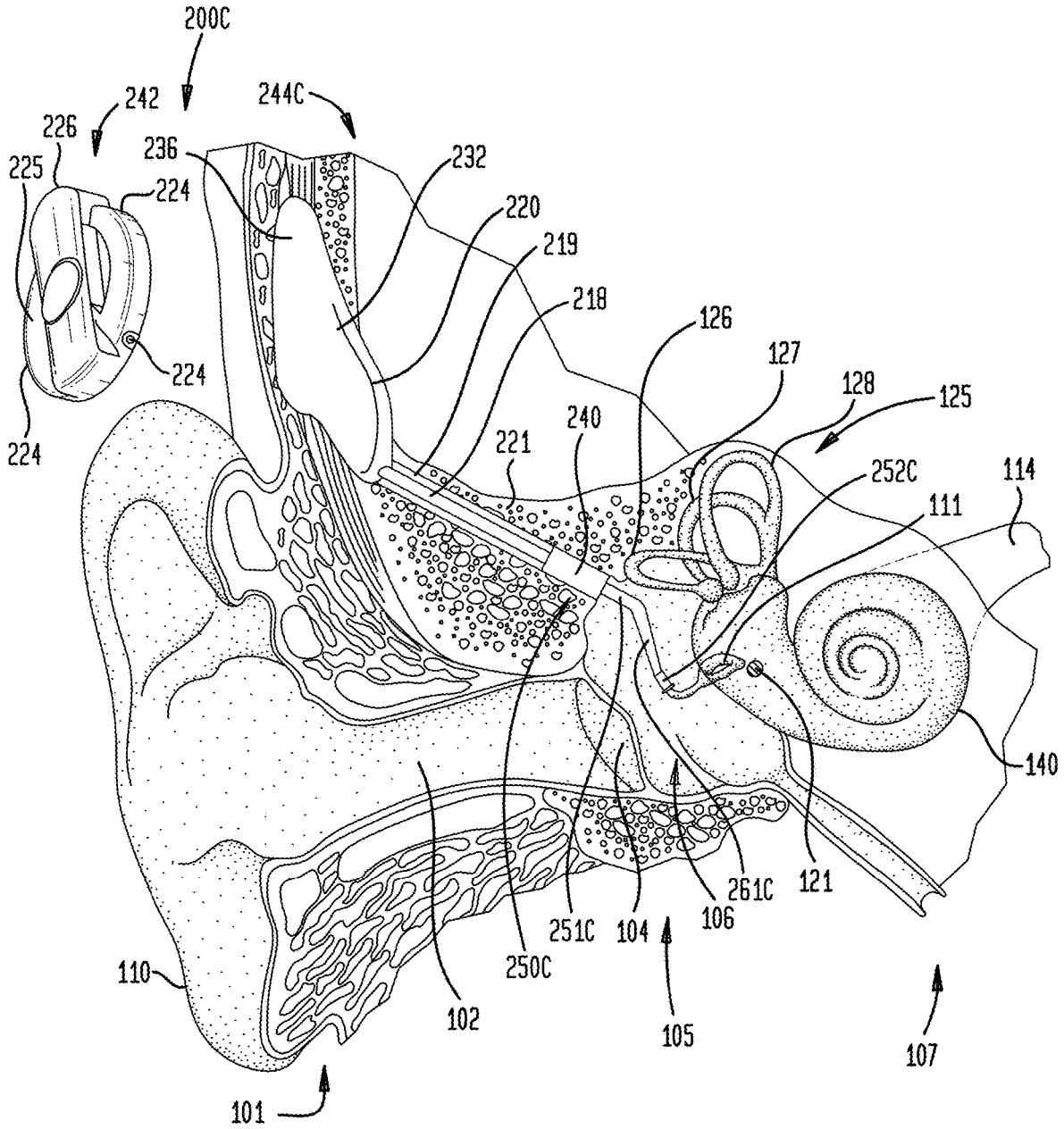
FIG. 2C is a perspective view of another exemplary DACI implanted in a recipient.

The arrangements of FIGS. 2A and 2B are exemplary arrangements of a middle ear implant that provides mechanical stimulation directly to cochlea 140. Other types of middle ear implants provide mechanical stimulation to middle ear 105. For example, middle ear implants may provide mechanical stimulation to a bone of ossicles 106, such to incus 109 or stapes 111. FIG. 2C depicts an exemplary middle ear implant 200C having a stimulation arrangement 250C comprising actuator 240 and a coupling element 251C. Coupling element 251C includes a stapes prosthesis 252C and an artificial incus 261C which couples the actuator to the stapes prosthesis. Here, stapes prosthesis 252C abuts stapes 111.

The bone conduction devices 100A and 100B include a component that moves in a reciprocating manner to evoke a hearing percept. The DACIs, 200B and 200C also include a component that moves in a reciprocating manner evoke a hearing percept. The movement of these components results in the creation of vibrational energy where at least a portion of which is ultimately transmitted to the sound capture element(s) of the hearing prosthesis. In the case of the active transcutaneous bone conduction device 100B and DACIs 200A, 200B, 200C, in at least some scenarios of use, all or at least a significant amount of the vibrational energy transmitted to the sound capture device from the aforementioned component is conducted via the skin, muscle and fat of the recipient to reach the operationally removable component/external component and then to the sound capture element(s). In the case of the bone conduction device 100A and the passive transcutaneous bone conduction device 100B, in at least some scenarios of use, all or at least a significant amount of the vibrational energy that is transmitted to the sound capture device is conducted via the unit (the operationally removable component/the external component) that contains or otherwise supports the component that moves in a reciprocating manner to the sound capture element(s) (e.g., because that unit also contains or otherwise supports the sound capture element(s)). In some arrangements of these hearing prostheses, other transmission routs exist (e.g., through the air, etc.) and the transmission route can be a combination thereof. Regardless of the transmission route, energy originating from operational movement of the hearing prostheses to evoke a hearing percept that impinges upon the sound capture device, such that the output of the sound capture device is influenced by the energy, is referred to herein as physical feedback.

Figure 3:
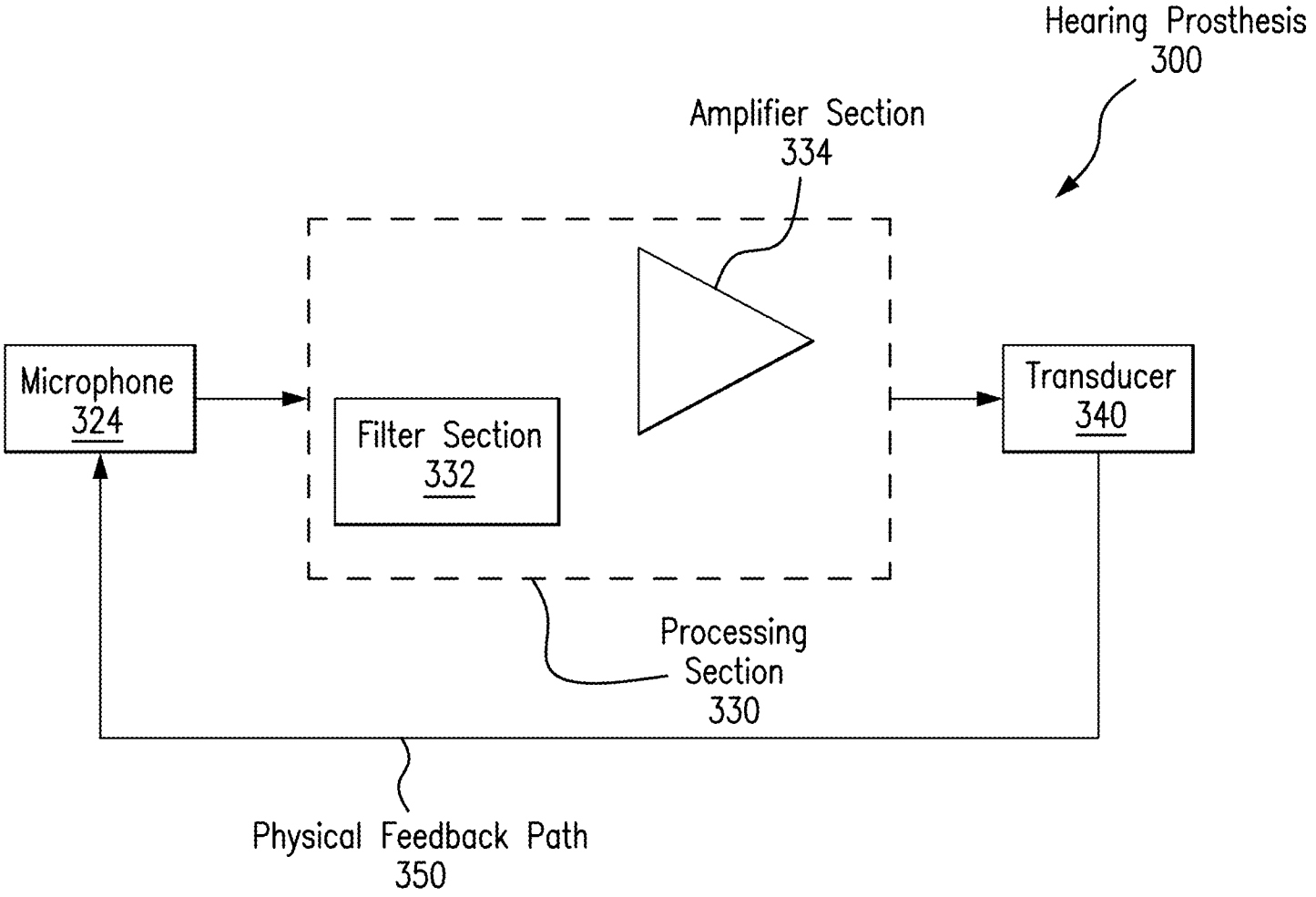
FIG. 3 is a functional diagram of an exemplary hearing prosthesis.

In broad conceptual terms, the above hearing prostheses and other types of hearing prostheses (e.g., conventional hearing aids, which the teachings herein and/or variations thereof are also applicable), operate on the principle illustrated in FIG. 3, with respect to hearing prosthesis 300. Specifically, sound is captured via microphone 324 and is transduced into an electrical signal that is delivered to processing section 330. Processing section 330 includes various elements and performs various functions. However, in the broadest sense, the processing section 330 includes a filter section 332, which, in at least some arrangements, includes is a series of filters, and an amplifier section 334, which amplifies the output of the processing section 330. (Note that in some instances, the signal from microphone 324 is amplified prior to receipt by filter section 332, and in other instances the application occurs after filter section 332 filters the signal from microphone 324. In some instances, amplification occurs both before and after the filter section 332 performs its function.) Processing section 330 can divide the signal received from microphone 324 into various frequency components and processes the different frequency components in different manners. In some instances, some frequency components are amplified more than other frequency components. The output of processing section 330 is one or more signals that are delivered to transducer 340, which converts the output to mechanical energy (or, in the case of a conventional hearing aid, acoustic energy) that evokes a hearing percept.

FIG. 3 further functionally depicts the physical feedback path 350 of a hearing prostheses. In some instances, the amount of feedback received by microphone 324, or, more accurately, the amount of influence of the feedback on the output of the microphone 324 limits the amount of gain that the processing section 330 applies to the received signal from the microphone 324, in totality and/or on a frequency by frequency basis. The amount of influence translates to a so-called gain margin of the processing section 330, which correlates to a frequency dependent maximum gain that is deemed to provide a utilitarian hearing percept evoking experience without subjecting the recipient to an unacceptable amount/level of feedback influenced hearing percepts, which includes none at all (hereinafter, the "feedback path gain margin"—note that this term as used is a physical characteristic of the individual prostheses that exists irrespective of whether its value is obtained). Put another way, the physical feedback can influences, or, more specifically, places limits on the highest value that can be set for the gain margin of the processing section 330. In at least some instances, the greater the influence of feedback on the output of the microphone 324, the lower the gain margin of the processing section 330. All things being equal, in at least some instances, higher values of gain margin have more utilitarian value than lower values of gain margin.

Accordingly, embodiments of at least some of the hearing prostheses detailed herein and/or variations thereof include a feature that enables the gain margin of the prosthesis to be set or otherwise adjusted. Some such embodiments include a hearing prosthesis that enables the gain margin to be set to a setting that is individualized to a specific prosthesis/user combination, for example, based on data obtained while the hearing prosthesis is implanted or otherwise prosthetically attached (e.g., as in the case of a conventional hearing aid or a behind the ear vibrator) as will be detailed below. Still further, some such embodiments include a hearing prosthesis that enables the gain margin to be set to a setting that is adjusted based on a particular wearing implementation of the hearing prosthesis and/or portion thereof as will be detailed below.

Figure 4:
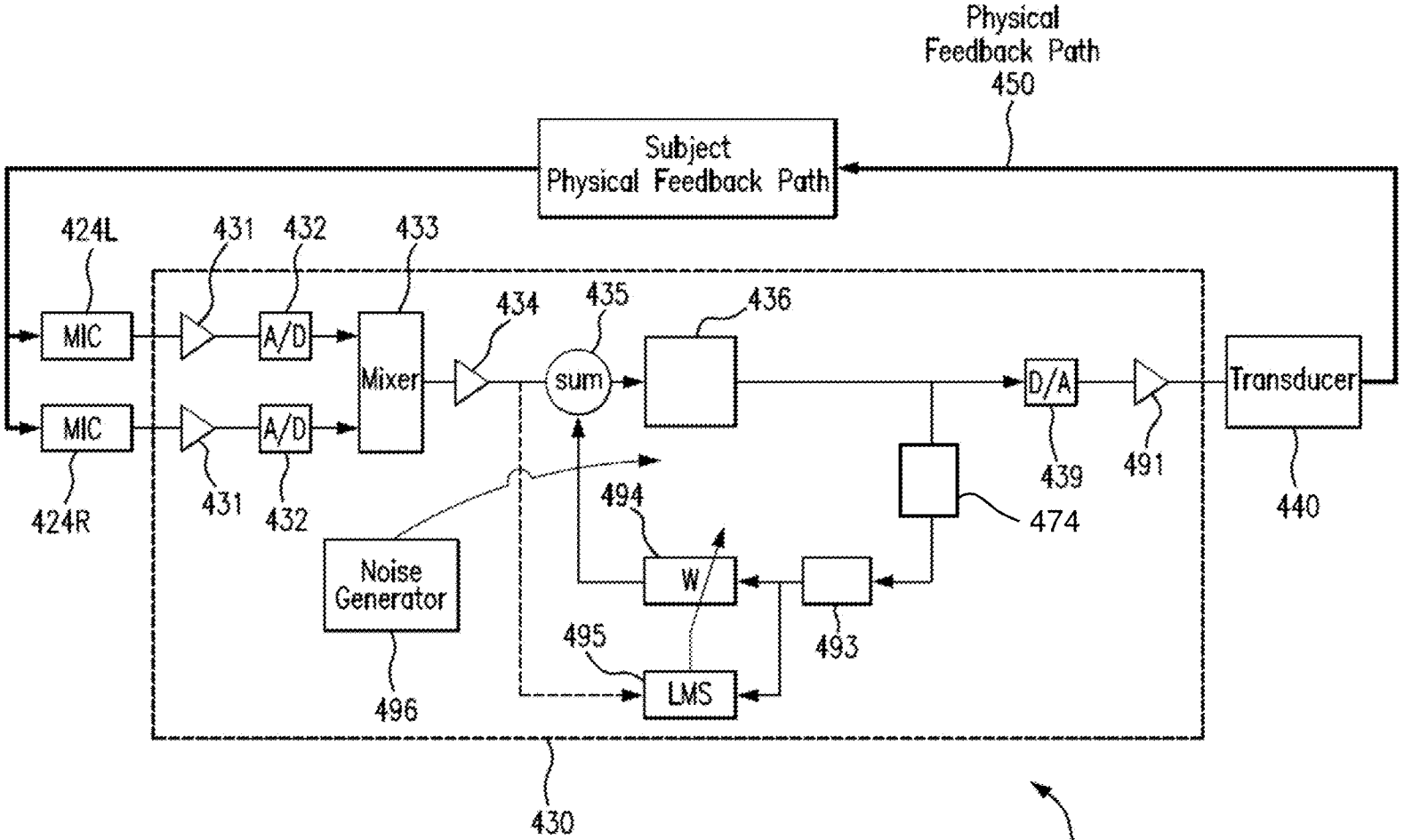
FIG. 4 is a functional diagraph depicting additional details of the hearing prosthesis of FIG. 3.

FIG. 4 functionally depicts an exemplary hearing prosthesis 400 and a physical feedback path of an exemplary hearing prosthesis corresponding to that of FIG. 3 (in greater detail), having a configuration such that the feedback path gain margin of the hearing prostheses can be measured or otherwise estimated while attached to the recipient. More particularly, microphones 424L and 424R correspond to microphone 324 of FIG. 3, processing section 430 corresponds to processing section 330 of FIG. 3, and transducer 440 corresponds to transducer 340 of FIG. 3. Physical feedback path 450 corresponds to path 350 of FIG. 3. Still referring to FIG. 4, as can be seen, the processing section 430 includes amplifiers 431, analog to digital converters 432, mixer 433, amplifier 434, summation device 435, gain equalizer 436, digital to analog converter 439 and amplifier 491. Processing section 430 further includes a feedback cancellation system that includes a pre-filter 493, filter system 494 having adjustable filter coefficients which is in communication with least mean squares block 495, the latter two elements collectively forming an adaptive system. In an exemplary embodiment, the least means squares filter system is a signed least mean squares filtered system. In an alternative embodiment, a normalized least means squares filter system and/or an ordinary least squares filter system can be utilized. Systems utilizing an algorithm based on a t-distribution and/or an M-estimation and/or an outlier detection adaptation system can be utilized in some embodiments. Any device, system or method that can be utilized to determine the filter coefficients or otherwise control the filter systems to practice the embodiments detailed herein and/or variations thereof can be utilized in a least some embodiments.

As can be seen, the processing section 430 further includes a noise generator 496 (although in alternate embodiments, the noise generator is not present/can be remote from the hearing prosthesis), which can be variously placed into and taken out of signal communication with the other components of the processing section 430, so as to input a noise into the system that has utilitarian value as will be described below.

Figure 5A:
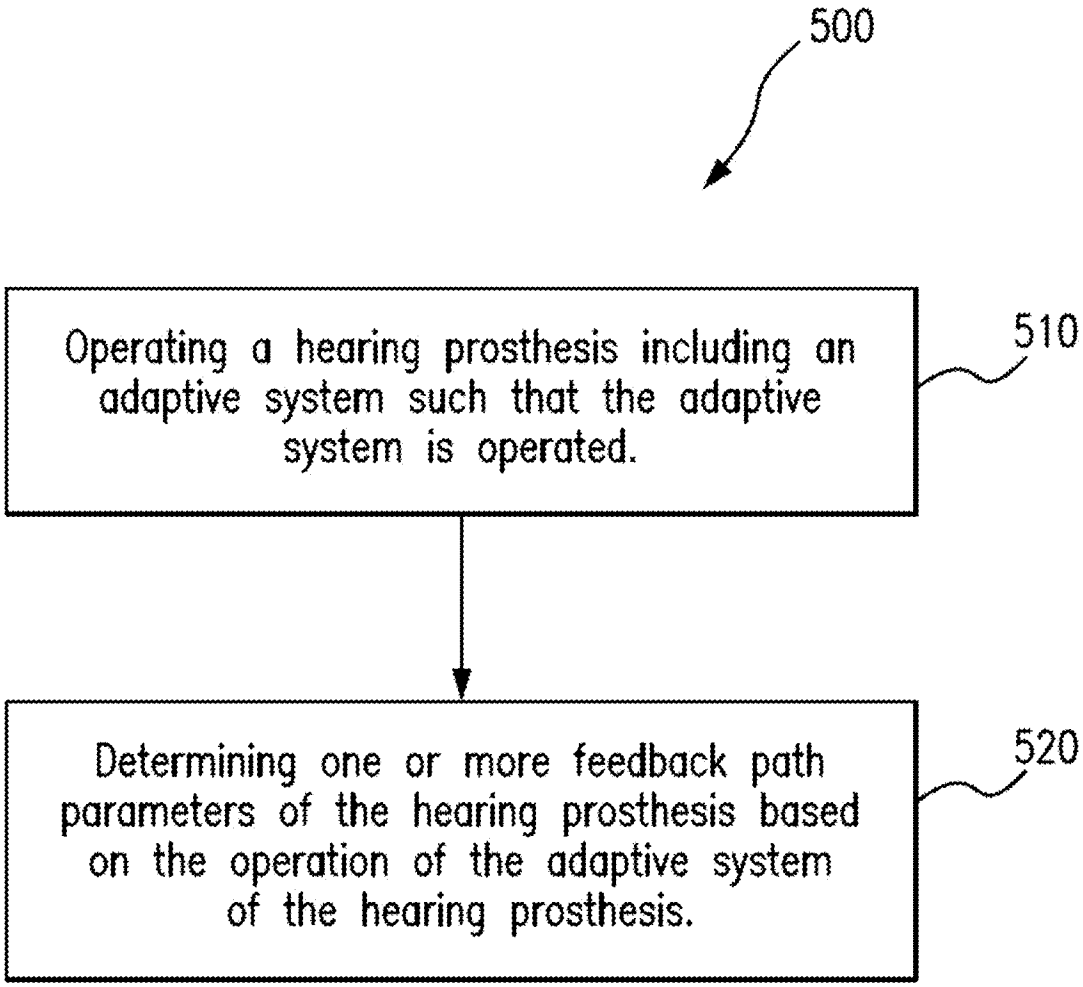
FIG. 5A is a flowchart for an exemplary method.

FIG. 5A presents a flowchart representing an exemplary method 500. More particularly, method 500 includes action 510 which entails operating a hearing prosthesis including an adaptive system such that the adaptive system is operated. Method 500 further includes method action 520, which entails determining one or more feedback path parameters of the hearing prosthesis based on the operation of the adaptive system of the hearing prosthesis. Additional details and variations of the method 500 will now be described.

In some instances, the adaptive system is a feedback management system, or at least is a part of a feedback management system. Accordingly, in an exemplary method, action 510 entails operating a hearing prosthesis including a feedback management system such that the feedback management system is operated, and method action 520 entails determining one or more feedback path parameters of the hearing prosthesis based on the operation of the feedback management system of the hearing prosthesis.

It is noted that reference to a feedback management system herein includes a feedback management system that utilizes an adaptive system of another system of the hearing prosthesis to operate or otherwise manage feedback. For example, a feedback management system can utilize an adaptive system that is part of an echo cancellation system or a beamforming system, etc. Accordingly, an operation of an adaptive system of a feedback management system of the hearing prosthesis can correspond to operation of an adaptive system that is part of an echo cancellation system if the adaptive system is used by the feedback management system, at least to manage feedback.

In an exemplary manner of practicing method 500 and/or the other methods detailed herein and/or variations thereof, the method includes the action of attaching the hearing prostheses 400 to a recipient in a manner generally the same as (including the same as) that which would be the case during normal use thereof (It is noted that in at least some instances, every method action detailed herein and/or variation thereof is practiced while the hearing prosthesis is implanted or otherwise prosthetically attached to the recipient, and, accordingly, any of the devices and systems and apparatuses detailed herein and/or variations thereof can be utilized with the hearing prosthesis so prosthetically attached). By way of example only, an audiologist can initiate a test routine associated with the hearing prostheses 400 that, among other things, enables the determination of one or more feedback path parameters based on the operation of the adaptive system of the feedback management system (e.g., determination of the feedback path gain margin). That is, it enables method action 520 to be executed. An exemplary test routine can include placing the noise generator 496 into signal communication with the other components of the processing section 430. The noise generator 496 generates noise, which ultimately causes transducer 440 to transducer energy (e.g., vibrate in the case of a bone conduction device) to evoke a hearing percept corresponding to the noise generated by the noise generator 496 (the aforementioned actions being an example of method action 510). In at least some instances, feedback through the physical feedback path 450 occurs.

In some instances, the one or more feedback path parameters determined in method action 520 include a feedback path gain margin. The feedback path gain margin can be determined based on data based on the adaptive part (adaptive system) of the feedback management system of the hearing prosthesis. More particularly, method action 520 can entail determining the one or more feedback path parameters based on data related to the adaptive filter coefficients of filters of the feedback management system. In this regard, for example, the filters of the feedback cancellation system represent the physical feedback path (e.g., physical feedback path 450 with respect to FIG. 4). That is, as the feedback path 450 changes, the feedback cancellation system of the hearing prosthesis 400 automatically adjusts to compensate for this changed feedback path. This adjustment is typically in the form of real-time changes to the filter coefficients of filter system 494.

In some instances, the action of determining the one or more feedback path parameters (method action 520) includes determining such based on data based on one or more values of the filter coefficients. That is, the determination is based on the actual value(s) of the filter coefficients are utilized in the determination. This means that the value(s) can be read from the filters and/or that data from the LMS block can be read (which is indicative of the values of the filter coefficients, because the filter coefficients are adjusted based on the output of the LMS block).

In some instances, the action of determining the one or more feedback path parameters (method action 520) can include determining the one or more feedback path parameters based on data related to an output of a sound capture system (e.g., the output of microphones 424L and 424R, after the output has been mixed by mixer 433 and amplified by amplifier 434, although in other instances, the output can be obtained upstream of one or more of these components) related to an input of an output transducer of the hearing prosthesis (e.g., the inputs directed to D/A converter 439, which leads to amplifier 491 and transducer 440 (the output transducer) —this being the signal that is directed to the adaptive filter system 493, although in other instances, the input can be obtained downstream of one or more of these components. In some instances, any data that is utilized to operate the feedback management system can be utilized to practice method action 520. It is further noted that the embodiments of FIG. 4 include a delay circuit 474, which enables a delay in the signal that is sent to filter system 494 and/or pre-filters 493, etc.

It is noted that in at least some exemplary embodiments of an exemplary feedback management system utilized with the prosthesis 400, one or more of the components of the embodiment of FIG. 4 may not necessarily be included in the system 400. Still further, the signal paths presented are exemplary, and the signal paths may be different. By way of example only and not by way of limitation, instead of the signal path traveling from the delay circuit 474 to the pre-filters 493, the signal path can travel from the delay circuit to the filter system 494. Still further, by way of example only and not by way limitation, a signal from the amplifier 434 and/or from the summation device 435 can be passed through a filter, such as a high pass filter or an adjustable filter or low-pass filter, or any other type of filter that will enable the teachings detailed herein and/or variations thereof, and provided to a so-called correlation device, which controls what passes through, in at least some exemplary embodiments, the correlation device can receive output from the pre-filters 493 as well. The correlation device can evaluate or other process or otherwise manage the signals, and provide an instruction to the filter system 494, to control the filter system 494, and thus control the output of the filter system 494 to the summation device 435.

Still keeping with the concept of the output of the sound capture system and the input to the output transducer being used to practice method action 520, in an exemplary method, one or more of the feedback path parameters is determined based on a statistical manipulation of the data related to an output of the sound capture system and the data related to the input of the output transducer of the hearing prosthesis. In an exemplary method, such can have utility in that coherence data can be collected or otherwise utilized to determine the feedback path parameters and/or adjust a functionality of the hearing prosthesis. (Application of such data will be detailed below.) For example, standard deviation data from the aforementioned input and output (corresponding to the inputs into the feedback management system) can be utilized to set the gain margin of the hearing prosthesis. Broadly speaking, the average (mean, median and/or in at least some instances, mode) of various readings (samples) of the input and the output and/or the components of the feedback management system at different temporal locations can be utilized to execute method action 520. This can have utility in that extraneous data, for example, can be smoothed out of and/or otherwise eliminated from the data utilized to determine the one or more feedback path parameters. In at least some instances, the statistical manipulation of the data is executed via a stochastic gradient decent method, such as, by way of example only and not by way of limitation, a least mean squares manipulation of the data (the data related to the output of the sound capture system and the inputs of the output transducer).

An exemplary method further includes applying criteria that is indicative of a sufficiently stable feedback path (sufficiently stable measurement results) to evaluate whether or not the determined one or more feedback path parameters is stable. For example, with respect to the just-detailed method, if the least mean squares data and/or the filter coefficients do not change over time/only change a relatively small amount over time, it is indicative of a feedback path that is not changing over time (or at least not significantly changing over time such that the changes influence in a meaningful way the occurrence of feedback). That is, it can be assumed that the feedback path is stable, and that the data has sufficient utility to determine one or more feedback path parameters based on that data. Put another way, it can be assumed that the determined feedback path parameters have sufficient validity such that they have sufficient utility to be utilized to adjust a functional parameter of the hearing prosthesis (e.g., set the gain margin of the hearing prosthesis based on the determined feedback path parameter(s), set a beamforming feature parameter based on the determined feedback path parameter(s), etc.). Further, an exemplary method entails developing criteria for determining when the determined feedback path parameters have sufficient utility.

Figure 5B:
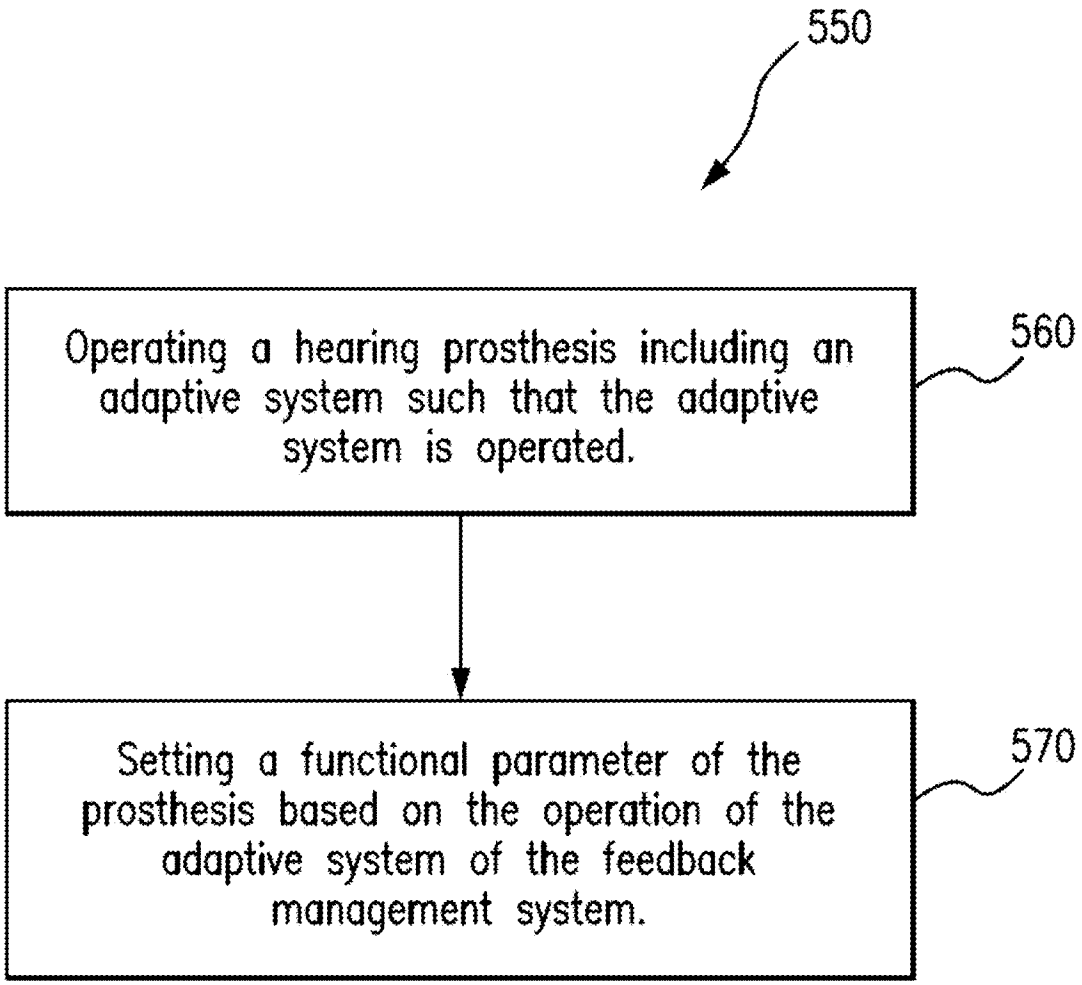
FIG. 5B is a flowchart for another exemplary method.

Referring now to FIG. 5B, an exemplary method includes an exemplary method 550 which includes method action 560, which entails operating a hearing prosthesis such that the adaptive system of the feedback management system thereof is operated. In this regard, method action 560 can be the same as method action 510 detailed above. Method 550 further includes method action 570, which entails setting a functional parameter, such as the gain margin, of the hearing prosthesis based on the operation of the adaptive system of the feedback management system thereof. With respect to setting the gain margin, there is utility in setting the gain margin of the hearing prosthesis based on the determined feedback path parameter, although it is noted that method 550 can be executed without an actual determination of a feedback path parameter (e.g., the raw data and/or modified data obtained as a result of method action 560 can be utilized to implement method action 570).

It is noted that instead of increasing or decreasing the gain margin, the gain margin to which the hearing prosthesis is set can be set can be determined via an analytical method. For example, an algorithm can be utilized to estimate where the gain margin should be set based on the operation of the adaptive system of the feedback management system.

Still further, there is an exemplary method of setting a gain margin of the hearing prosthesis based on a determination that the collected readings (samples) indicates coherence of the readings (samples). More particularly, an exemplary method can include collecting samples at different temporal locations of parameters related to the feedback management system of the hearing prosthesis. In an exemplary method, the parameters can include data related to the filter coefficients as detailed herein and/or variations thereof. These readings/samples can be statistically analyzed and, upon a determination that the statistical analysis indicates coherence, the gain margin can be set based on the collected samples (readings.)

In an exemplary method, utilizing a computer or other equivalent system or alternate system configured to provide corresponding utilitarian functionality, including fitting software or the like, placed into signal communication with the prostheses 400, the filter coefficients are read from filter system 494 and/or the output of the least mean squares block 495 is read, and/or data based on that data is read. From this data, one or more feedback path parameters of the hearing prosthesis based on the operation of the adaptive system of the feedback management system (or of another system in some alternate methods) thereof can be determined (method action 520). This process can be repeated (including, optionally, additional steps and/or fewer steps) where the gain of the processing section 430 is increased and/or decreased. That is, the process can be repeated in an iterative manner. In an exemplary method, from these readings and/or from the recipient interrogation, the feedback path gain margin can be obtained.

More particularly, in an exemplary method, method 550 further includes the action of evaluating the filter coefficients of the adaptive filter system and/or the output of the least mean squares block, including utilizing any of the statistical evaluation methods detailed herein and/or variations thereof, to determine whether feedback is occurring at a given gain margin of the hearing prosthesis. A low value (including a zero value) of the filter coefficients and/or a low value (including a zero value) of the least mean squares block is indicative of little to no feedback. Thus, in an exemplary method, the gain margin is increased in an iterative manner while the noise generator generates noise (and/or noise is inputted remotely into the hearing prosthesis) until these values are no longer low. The gain margin of the hearing prosthesis is then set to a value corresponding to that just before the values changed and/or that just before the values changed plus a safety factor. In an alternative method, the gain margin is decreased in an iterative manner while the noise generator generates noise (and/or noise is inputted remotely into the hearing prosthesis) until these values correspond to low values (at least providing that the recipient is agreeable to such a regime). The gain margin of the hearing prosthesis is then set to a value corresponding to that where the values changed and/or that where the values changed plus a safety factor.

Hereinafter, techniques of the hearing prostheses to manage or otherwise account for feedback will be sometimes referred to as feedback algorithms. The actions associated with the adjustment of various components/processes thereof can be included in the concept of adjusting a parameter or adjusting a setting/changing a parameter/changing a setting of the hearing prosthesis. Thus, any adjustment, change, setting, etc. detailed above can be applicable to the following.

It is noted that the above hearing prostheses 100A, 100B, 200A, 200B, and 200C, hereinafter the "above noted hearing prostheses," variously can have different feedback algorithms (although in some instances, the feedback algorithms are the same). By way of example only and not by way of limitation, the percutaneous bone conduction device 100A utilizes a different algorithm than that of 100B, owing to the fact that the feedback path is different. Still further, it is noted that various prostheses can have different wearing options. By way of example only and not by limitation, with respect to bone conduction devices, the "same" external component (e.g., the operationally removable component of 100A—sometimes referred to in the art as "the sound processor") can be utilized in a variety of different manners. By way of example only and not by way of limitation, an exemplary embodiment, the operationally removable component can be snapped coupled or otherwise connected to a vibrator plate, such as that detailed in U.S. Patent Application Publication No. US20120302823, entitled Convertibility of a Bone Conduction Device, to Marcus Andersson and Goran Bjorn, filed on May 31, 2012.

In such an exemplary embodiment, the operational removable component can be utilized as a transcutaneous bone conduction device. That is, the operationally removable component of the percutaneous bone conduction device can be utilized in a passive transcutaneous bone conduction system. In an exemplary embodiment, this is as simple as uncoupling the operationally removable component from the percutaneous abutment, attaching a vibrator plate or the like to the operationally removable component, and then placing the operationally removable component against the skin of the recipient. In an exemplary embodiment, there is an implanted magnet in the recipient, and the vibrator plate also includes magnet, so as to establish a magnetic coupling between the two components. Effectively, such a configuration corresponds to that seen in FIG. 1B. Still further by way of example only and not by way limitation, in some of the utilization of a magnetic coupling, a completely external system can be utilized to hold the operationally removable component with the vibrator plate to the skin. In an exemplary embodiment, a headband can be utilized that wraps around the entire head of the recipient and holds the external component against the skin. In at least some exemplary embodiments of these exemplary embodiments, the feedback path will be different, owing to the fact that the manner in which the external component is held against the recipient is different in each instance. Still further, the feedback path can be different owing to the fact that the location of the microphone has changed relative to the recipient in general, or at least relative to the particular anatomical structure of the recipient proximate the bone conduction device. For example, the thickness of skin over the mastoid bone could be different at the different locations. The feedback path can be different for a host of reasons.

Still further, in other embodiments, different sound capture devices are utilized for the same system. By way of example only and not by way of limitation, so-called remote microphones can be utilized with any of the hearing prostheses detailed herein and/or variations thereof. In an exemplary embodiment, instead of, for example, utilizing the microphone 124A of the prosthesis 100A, a remote microphone can be utilized to capture sound. This remote microphone is part of an assembly that can transmit a signal to the external component/operationally removable component so that the operationally removable component can operate as if the signal was outputted by microphone 124A. This transmission of the signal can be performed wirelessly and/or in a wired manner. The point is, the utilization of the different microphone will change the feedback path, both with respect to the fact that the location is different relative to the recipient, and with respect to the fact that the location of the microphone relative to the transducer that generates the vibrations that are outputted to the recipient is different.

Moreover, in some exemplary embodiments, the position of the external component can be different with respect to different uses. For example, with respect to the button sound processor of 200A-200C, the rotational angle of the external component 242 can be different. This will change the location of the microphones, etc.

With respect to the teachings herein, any change to the locationality of a component of a hearing prosthesis that will change the feedback path is addressed according to at least some exemplary embodiments.

In at least some exemplary embodiments, the feedback algorithm is not changed irrespective of how the hearing prosthesis is worn or otherwise positioned on the recipient. That is, in an exemplary embodiment, the exact same underlying feedback algorithm is utilized for some and/or all positions of the various portions of the hearing prosthesis, all other things being equal. Conversely, in some other exemplary embodiments, the feedback algorithm is changed depending on how the hearing prosthesis is worn or otherwise positioned on the recipient.

Figure 6:
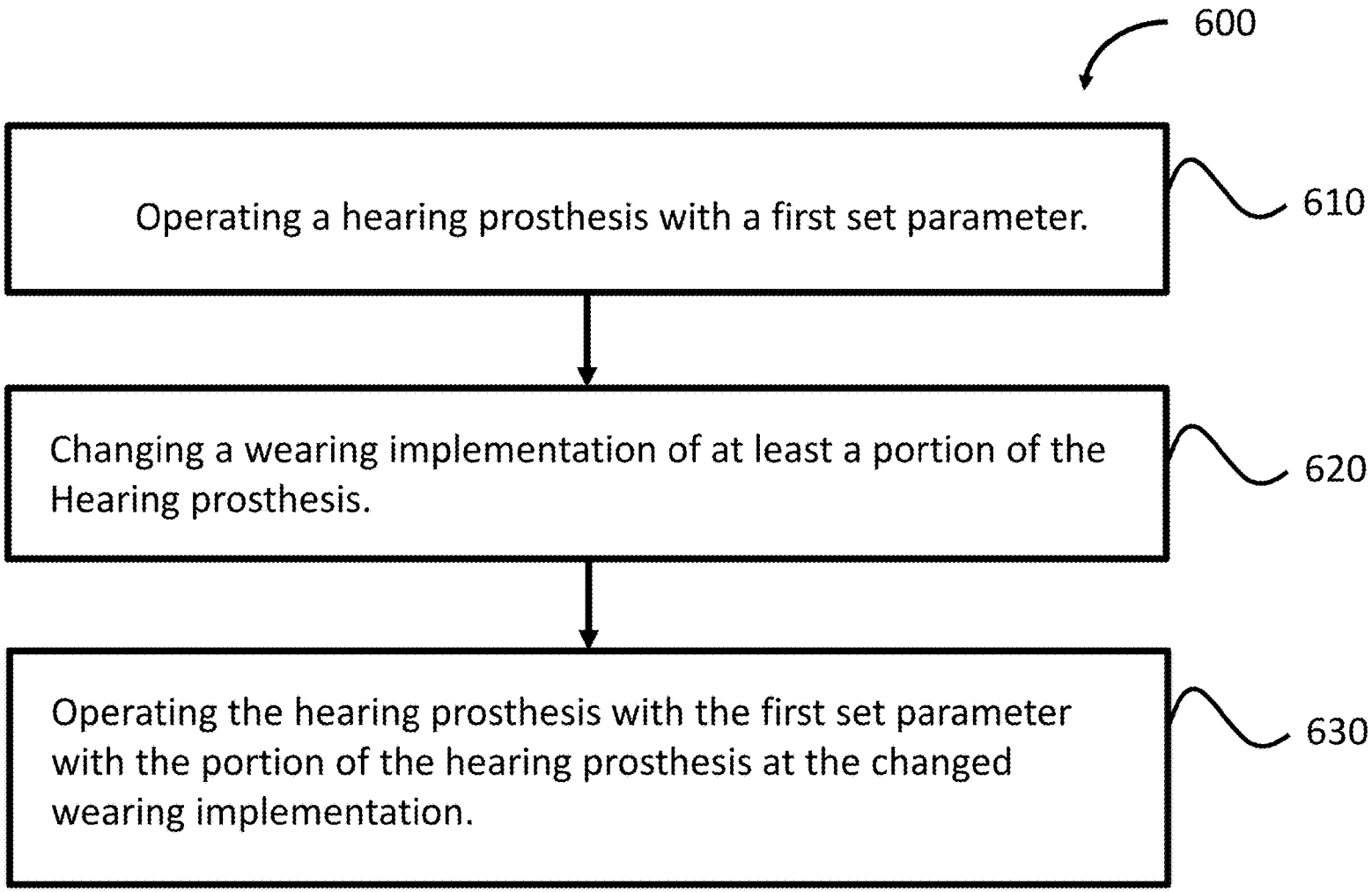
FIG. 6 is a flowchart for another exemplary method.

Thus, in an exemplary embodiment, with reference to FIG. 6, there is an exemplary method 600 which includes method action 610, which entails operating a hearing prosthesis with a first set parameter while the hearing prosthesis is utilized in a first wearing implementation. By way of example only and not by way of limitation, the first set parameter could be a gain setting of the hearing prosthesis. Method 600 further includes method action 620, which entails changing a wearing implementation of at least a portion of the hearing prosthesis to a second wearing implementation. By way of example only and not by way limitation, with respect to, for example, the bone conduction device of FIGS. 1A and 1B, this could entail utilizing the operational removable component as a transcutaneous bone conduction device instead of a percutaneous bone conduction device. Alternatively and/or in addition to this, this could entail moving the location of the microphone.

Method 600 further includes method action 630, which entails operating the hearing prosthesis with the first set parameter (e.g., the same gain setting is that utilized when the hearing prosthesis was operated at the first wearing implementation), with a portion of the hearing prosthesis at the changed wearing implementation (the hearing prosthesis is in the second wearing implementation).

Figure 7:
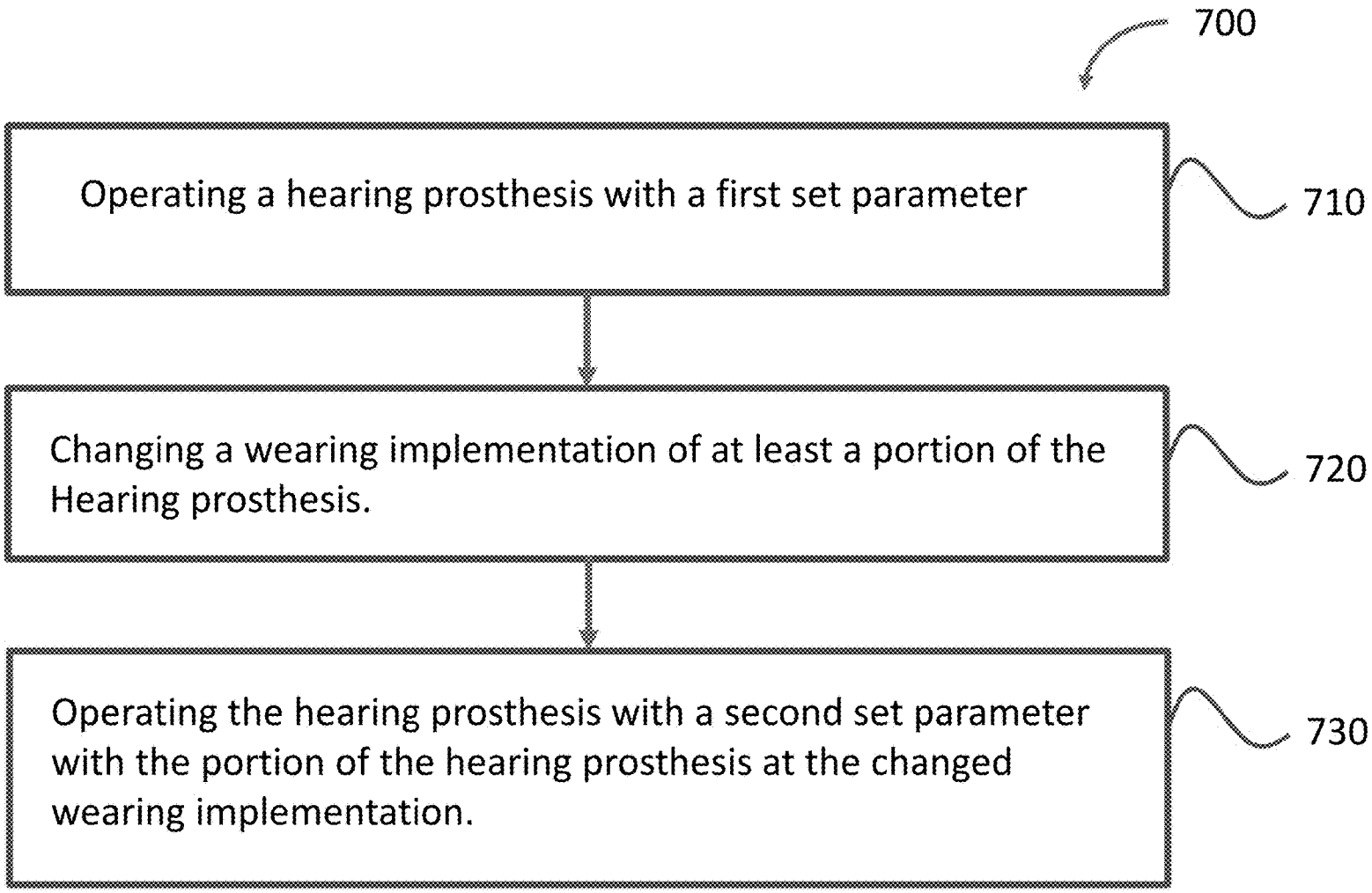
FIG. 7 is a flowchart for another exemplary method.

Converse to method 600, now with reference to FIG. 7, there is an exemplary method 700 which includes method action 710, which entails operating a hearing prosthesis with a first set parameter while the hearing prosthesis is utilized in a first wearing implementation. By way of example only and not by way of limitation, the first set parameter could be a feedback algorithm of a plurality of feedback algorithms of the hearing prosthesis. Method 700 further includes method action 720, which entails changing a wearing implementation of at least a portion of the hearing prosthesis to a second wearing implementation. By way of example only and not by way of limitation, with respect to, for example, the bone conduction device of FIGS. 1A and 1B, this could entail utilizing the operational removable component of the transcutaneous bone conduction device of 100B in the so-called soft band configuration as opposed to with the bone conduction device magnetically coupled to the recipient. Alternatively, and/or in addition to this, this could entail moving the location of the microphone from that which was the case in the first wearing implementation.

Method 700 further includes method action 730, which entails operating the hearing prosthesis with the second set parameter (e.g., a different feedback algorithm from amongst the plurality of feedback algorithms available in the hearing prosthesis), with a portion of the hearing prosthesis at the changed wearing implementation (the hearing prosthesis is in the second wearing implementation).

In at least some exemplary embodiments, changing a parameter of the hearing prosthesis due to a change wearing implementation can have utilitarian value in that the feedback management system can be more targeted to the feedback path that exists due to the changed wearing implementation. Indeed, in an exemplary embodiment, it may not be necessary to even have a feedback routine operating in some wearing implementations. By way of example only and not by way of limitation, in an exemplary embodiment where the microphone is located remote from the recipient (e.g. such as on a table or the like), the likelihood of feedback occurring is relatively low. Accordingly, the gain of the system can be maximized or otherwise optimize without or otherwise with relatively minimized concern for the effects of feedback. Accordingly, it is to be understood that adjusting a parameter the hearing prosthesis entails shutting off a feedback management system as well as varying a feedback management system. (In an exemplary embodiment, this gain setting is set in accordance with the gain margin determined according to the teachings above as correlated to various wearing implementations—this is described in greater detail below.)

Figure 8A:
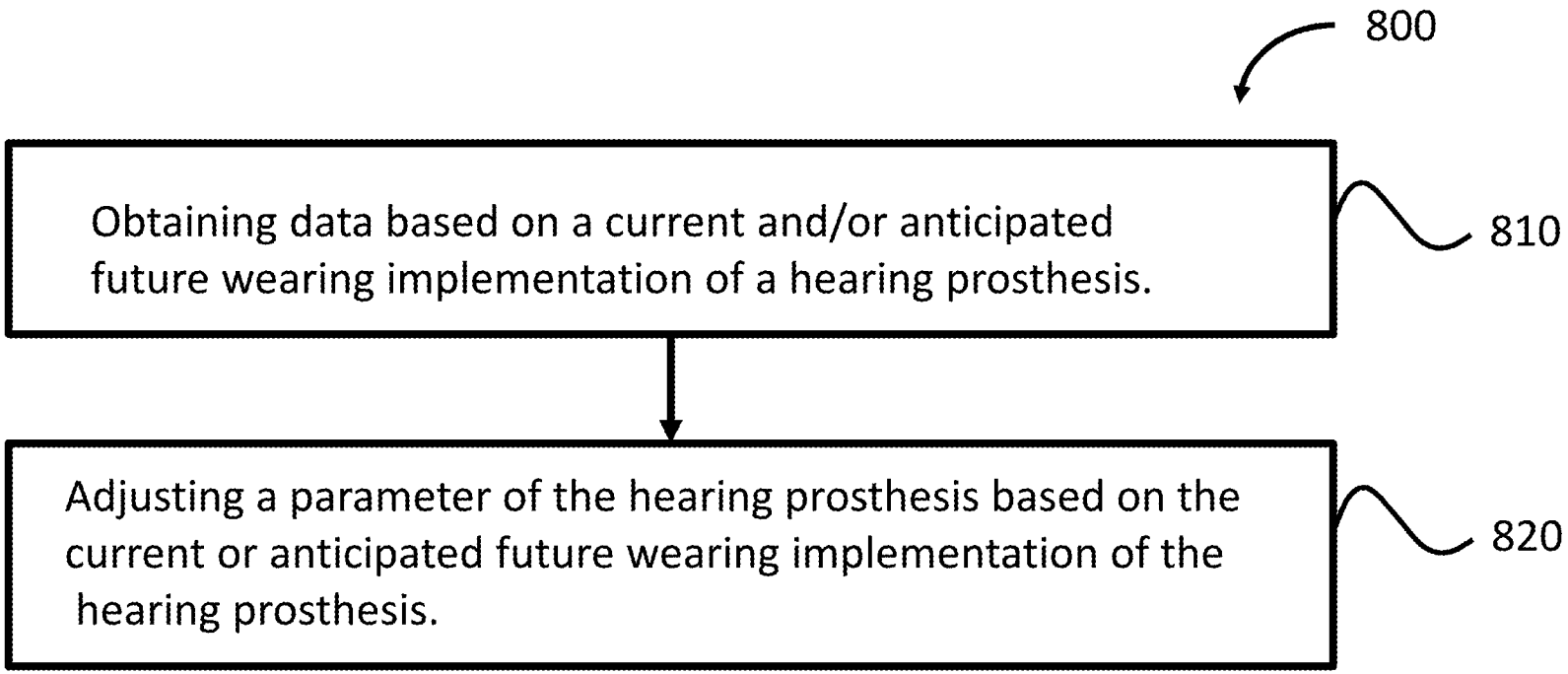
FIG. 8A is a flowchart for another exemplary method.

In view of such utilitarian value, method 800, as presented in FIG. 8A, depicts an exemplary method according to an exemplary embodiment. As can be seen, method 800 entails method action 810, which entails obtaining data based on a current and/or an anticipated future wearing implementation of a hearing prosthesis. By way of example only and not by way of limitation, the wearing implementation at issue in method action 810 could be the use of the hearing prosthesis in the percutaneous bone conduction mode. Method action 810 can be implemented manually and/or automatically, such as, by way of example only and not by way of limitation, by a processor that is programmed to obtain data that will enable the processor to determine the current and/or anticipated future wearing implementation of the hearing prosthesis (this is discussed in greater detail below). Thus, in an exemplary embodiment, the hearing prosthesis can be configured to obtain such data. Still further, in an exemplary embodiment, the hearing prosthesis can be configured to evaluate the data and determine the current and/or anticipated future wearing implementation of a hearing prosthesis. In an exemplary embodiment, the data can entail input indicating that, for example, the operationally removable component of prosthesis 100A is removed from the abutment, which thus indicates that the wearing implementation will change (e.g., to that of transcutaneous bone conduction device implementation). In an exemplary embodiment, the data can entail input from a user into a user interface of the hearing prosthesis (e.g., a button) corresponding to data relating to the current and/or anticipated future wearing implementation of the hearing prosthesis.

Still with reference to FIG. 8A, method 800 further includes method action 820, which entails adjusting a parameter of the hearing prosthesis based on the current or anticipated future wearing implementation of the hearing prosthesis. By way of example only and not by way of limitation, this can entail changing a feedback algorithm and/or shutting down a feedback management system entirely and/or activating a previously shut down feedback management system. Any parameter of the hearing prosthesis that is adjustable (which includes activatable and deactivatable) can be included in the adjusted parameter of method action 820.

It is noted that in some exemplary embodiments, in the case of a current wearing implementation, the current wearing implementation is different from a previous wearing implementation. In some embodiments, in the case of a future wearing implementation, the future wearing implementation is different from a current wearing implementation.

Some exemplary embodiments of the different wearing implementations will now be described.

As noted above, an exemplary current or anticipated future wearing implementation is an implementation where a microphone of the hearing prosthesis is located away from a head of the recipient. By way of example only and not by way of limitation, in at least some exemplary embodiments, the component of the hearing prosthesis that contains or otherwise includes a sound capture apparatus (e.g., microphone) is movable relative to the body of the hearing prosthesis while still being able to evoke a hearing percept at various locations. As noted above, in an exemplary embodiment, with respect to embodiments utilizing the so-called soft band configuration, the external component of the bone conduction device can be located virtually anywhere on the head of the recipient. Still further by way of example only and not by way of limitation, in at least some exemplary embodiments, the component of the hearing prosthesis that contains or otherwise includes a sound capture apparatus (e.g., microphone) is movable relative to the actuator that generates or otherwise outputs the vibrations that stimulate the tissue to evoke a hearing percept. (It is noted at this time that the phrase wearing implementation includes an implementation where the microphone is not physically connected or otherwise in direct contact with the recipient (including the clothing thereof.)

Accordingly, in an exemplary embodiment, the current or anticipated future wearing implementation is an implementation where a microphone of the hearing prosthesis is at a different distance from a location of tissue stimulation relative to another wearing implementation. Alternatively, and/or in addition to this, in an exemplary embodiment, the current or anticipated future wearing implementation is an implementation where a microphone of the hearing prosthesis is at a different distance from a location of an actuator that generates output that causes tissue stimulation relative to another wearing implementation. The ramifications of the microphone being at a different distances from the tissue that is stimulated and/or the actuator is that the feedback path is changed. Some additional details of the ramifications of such will now be described.

In an exemplary embodiment where the different distance causes the feedback path (distance from the actuator to the microphone, distance from the stimulated tissue to the microphone, etc.) to be lengthened relative to other wearing implementations, the temporal period required for the energy to travel from the actuator and/or from the stimulated tissue to the microphone to generate the feedback will lengthen. (Note further that a lengthening of the temporal time period can also occur with respect to the change in medium through which the energy travels due to movements of the various components of the hearing prosthesis (e.g., due to a more dense medium, etc.—embodiments of the teachings detailed herein and/or variations thereof can be utilized to account for this phenomenon as well). Thus, in an exemplary embodiment, with respect to the adjusted parameter of the method 800, in an exemplary embodiment, the adjusted parameter is a feedback adaption speed of the hearing prosthesis. In this regard, because the feedback energy will arrive at the microphone at a later time. Then that which would be the case if the pertinent distances were shorter, there is utilitarian value in slowing down the feedback adaptation speed. By way of example only and not by way of limitation, a first time delay with respect to a first wearing implementation could be 0.1 to 0.4 milliseconds (e.g., the time delay for a button sound processor device where the microphones are located or otherwise supported on the same chassis as the actuator) A second time delay with respect to a second wearing implementation could be, for example, 0.8 ms (e.g., the time delay that can occur where the actuator is located or otherwise supported on a first chassis that is separate from a second chassis that supports the microphone—by way of example only and not by way of limitation, an arrangement where the microphone is contained in or otherwise supported by a BTE device, which is, for example, worn over the ear, such as that depicted in FIG. 12 with respect to element 100, as will be described in greater detail below, and the actuator 349 (with reference to FIG. 13, details of which are provided below) is located in a button device held against the mastoid bone via a magnet system or by adhesive (both conceptually represented by element 351) or by a soft band, etc., at a location that is, for example, 5 to 10 or more centimeters away from the BTE device in general, and the microphone 127 in particular—a so-called split system). A third time delay could be, with respect to a third wearing implementation, for example, 1.3 ms (e.g., the time delay that can occur when the actuator is located or otherwise supported on a first chassis that is separate from a second chassis that supports the microphone, with the second chassis is located at a position relative to the recipient that is distinctly anatomically different in a global manner (e.g., worn at a location of a shirt pocket, worn at a location over the chest (i.e., at a front of the recipient as opposed to the side of the recipient))).

As can be seen, the time delays could be up to 2 to 3 times as long, depending on how the hearing prosthesis is worn or otherwise utilized. (It is noted that the time delays could be even longer in some instances—in the exemplary embodiment, a first time delay and/or a second time delay and/or third time delay can be a time delay of about 0.05, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 2.0 ms or more or any value or range of values between any of these in 0.001 ms increments (e.g., 0.222, 0.333, 0.101 to 1.123 ms, etc.).) In at least some exemplary embodiments, the feedback management systems will have more utilitarian value or otherwise be able to manage feedback better if the feedback management system is configured to address a given delay time. In at least some exemplary embodiments, for example, if the feedback management system is configured for a delay time of, for example, 0.3 ms, and the feedback path delay time results in a longer time such that, for example, there are 20 samples longer than that which would be the case for the 0.3 ms of delay time, the resolution of the filtering will be reduced. For example, if the adaptive filter system of the feedback system utilizes 40 FIR filter taps, in at least some exemplary embodiments in this exemplary scenario, only about half, 20 taps will be utilized for the adaptation against the feedback. Accordingly, by utilizing a different time delay depending on the delay time, more filter taps could be utilized than what otherwise might be the case, thus providing more utilitarian value for a given feedback management regime.

Accordingly, in an exemplary embodiment, there is a hearing prosthesis that is configured to enable an adjustment of a delay of a feedback algorithm to accommodate a change in location of at least a portion of the hearing prosthesis. In an exemplary embodiment, the hearing prosthesis is configured to do this automatically based upon a sensation by the hearing prosthesis that such a change in location has occurred (directly and/or via the utilization of latent variables). In an exemplary embodiment, the hearing prosthesis is configured to enable a recipient to adjust the delay of a feedback algorithm via a user interface of the hearing prosthesis, which may be an integral portion of a main component of the hearing prosthesis, or which may be a remote component, such as a so-called smart phone that has an application that enables the recipient to adjust the delay of the feedback algorithm. Any device, system, and/or method that will enable the adjustment of a delay of the feedback algorithm so as to permit the various teachings detailed herein and/or variations thereof to be practiced, can be utilized in at least some exemplary embodiments.

Accordingly, in an exemplary embodiment of method 700, the parameter of the hearing prosthesis is a number of filter taps utilized in a feedback algorithm of the hearing prosthesis, and the action of adjusting the parameter entails increasing and/or decreasing the number of filter taps to accommodate a change in the location of at least a portion of a sound capture device, such as a microphone, of the hearing prosthesis.

Accordingly, in an exemplary embodiment, the action of adjusting a parameter of the hearing prosthesis in method action 820 entails adjusting the feedback management system such that the feedback management system accounts for the delay associated with the current and/or anticipated future wearing implementation of the hearing prosthesis. By way of example only and not by way of limitation, this can entail utilizing a different feedback algorithm. In an exemplary embodiment, this can entail adjusting an artifact delay in the feedback management circuit of the hearing prosthesis. Of course, it is noted that all of the above applies in reverse for scenarios where the feedback path is shortened. Any device, system, and/or method that will result in compensation for the lengthened and/or shortened feedback path due to the change in the wearing implementation of the hearing prosthesis can be utilized in at least some embodiments with respect to adjusting a parameter the hearing prosthesis based on the current and/or anticipated future wearing implementation of the hearing prosthesis.

It is noted that in at least some embodiments, the wearing implementation of the hearing prosthesis corresponds to predetermined implementations. Thus, in an exemplary embodiment, the given feedback paths associated there with can also be predetermined or otherwise estimated. Thus, by a identifying the various expected wearing implementations in determining the feedback paths for those wearing implementations, the hearing prosthesis can be configured with a variety of algorithms and/or parameter settings that can be changed or otherwise set for a given wearing implementation, thus corresponding to a given feedback path resulting therefrom. Accordingly, in an exemplary embodiment, there is a hearing prosthesis configured to adjust a feedback management regime (which also includes cancel and/or activate) based on an adjustment of the wearing configuration of the prosthesis. Still further, in an exemplary embodiment, there is a hearing prosthesis configured to implement a feedback management regime (which also includes cancel and/or activate) based on an implementation of a given wearing configuration of the hearing prosthesis. It is noted that these adjustments and/or implementations can be performed automatically by the hearing prosthesis, based on a determination that the wearing configuration has changed and/or that a given wearing configuration has been implemented. In an exemplary embodiment, this can be done based on input from a recipient as to the current and/or anticipated future wearing regime. In an exemplary embodiment, this can be done based on automatic sensation by the hearing prosthesis of the current and/or anticipated future wearing regime. In at least some exemplary embodiments, this can be achieved via the utilization of latent variables that are indicative of a current and/or anticipated future wearing regime.

It is further noted that these adjustments and/or implementations can be performed manually as well in at least some exemplary embodiments. By way of example only and not by way of limitation, a recipient can change a setting of the hearing prosthesis to correspond to a feedback management regime for a given wearing regime. This can be done via a user input system one the hearing prosthesis or remote from the hearing prosthesis. Indeed, in an exemplary embodiment, a so-called smart phone or the like is in communication with the hearing prosthesis. The recipient can select a given feedback regime that he or she desires based on a given wearing regime by touching a touch screen of the smart phone, and the smart phone adjusts the feedback regime of the hearing prosthesis based on this input.

It is also noted that any reference herein to a determination of a wearing configuration also includes a determination that a wearing configuration has changed, and vice versa. In this regard, while in some exemplary embodiments, a change to a given feedback regime can be implemented based on a determination that the hearing prosthesis is being utilized in a given wearing regime, in other exemplary embodiments, a change to a given feedback regime can be implemented based on a determination that a wearing regime has changed without an understanding of the actual wearing regime to which the prosthesis is been changed. Any device, system, and/or method, that will enable the triggering of the adjustments of the parameter the hearing prosthesis according to the methods detailed herein in a manner that has utilitarian value can be utilized in at least some exemplary embodiments.

Figure 8B:
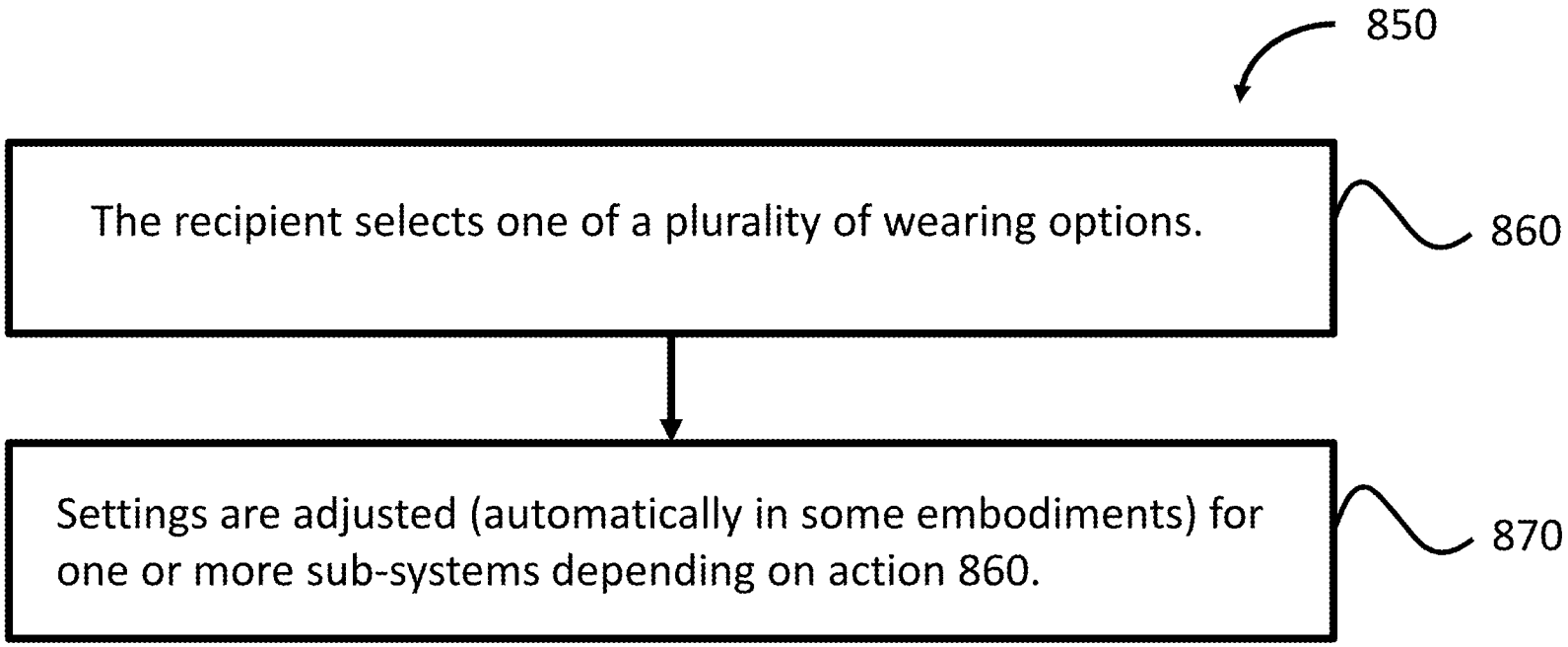
FIG. 8B is a flowchart for another exemplary method.

FIG. 8B presents an algorithm for a method 850 according to an exemplary embodiment. Method 850 includes method action 860, where a recipient of the hearing prosthesis selects one of a plurality of wearing options has presented or otherwise available to be selected via an input interface of the hearing prosthesis. In at least some exemplary embodiments, such input interface can be presented on a so-called smart phone or the like, which includes an application that enables such input. Some exemplary input regimes of some exemplary wearing options are detailed below. In an exemplary embodiment, method action 860 is executed during a change of a wearing option of the hearing prosthesis or in relatively close proximity to such change (before and/or after the change). In an exemplary embodiment, method action 860 is executed prior to the utilization of the hearing prosthesis, at least with respect to a given day or the like. Method 850 further includes method action 870, which entails the adjustment of the settings/parameters for one or more subsystems depending on action 860. In an exemplary embodiment, if the wearing option is selected, for example, for a remote microphone, a setting/parameter for the gain might be adjusted to increase the gain relative to that which would be the case for, for example, on body wearing of the microphone. It is noted that method action 870 can entail the adjustment of one or more subsystems. In this regard, by way of example only and not by way of limitation, a gain regime and a feedback management regime can be adjusted. That is, more than one subsystem can be adjusted based on the selection of a given wearing option. It is further noted that in at least some exemplary embodiments of method action 870, this can entail the selection of different maps/programs depending on action 860 (map selection/adjustment is discussed in greater detail below). In this regard, a map, a gain, and a feedback management regime can all be adjusted depending on the wearing option selected during method action 860.

Figure 9:
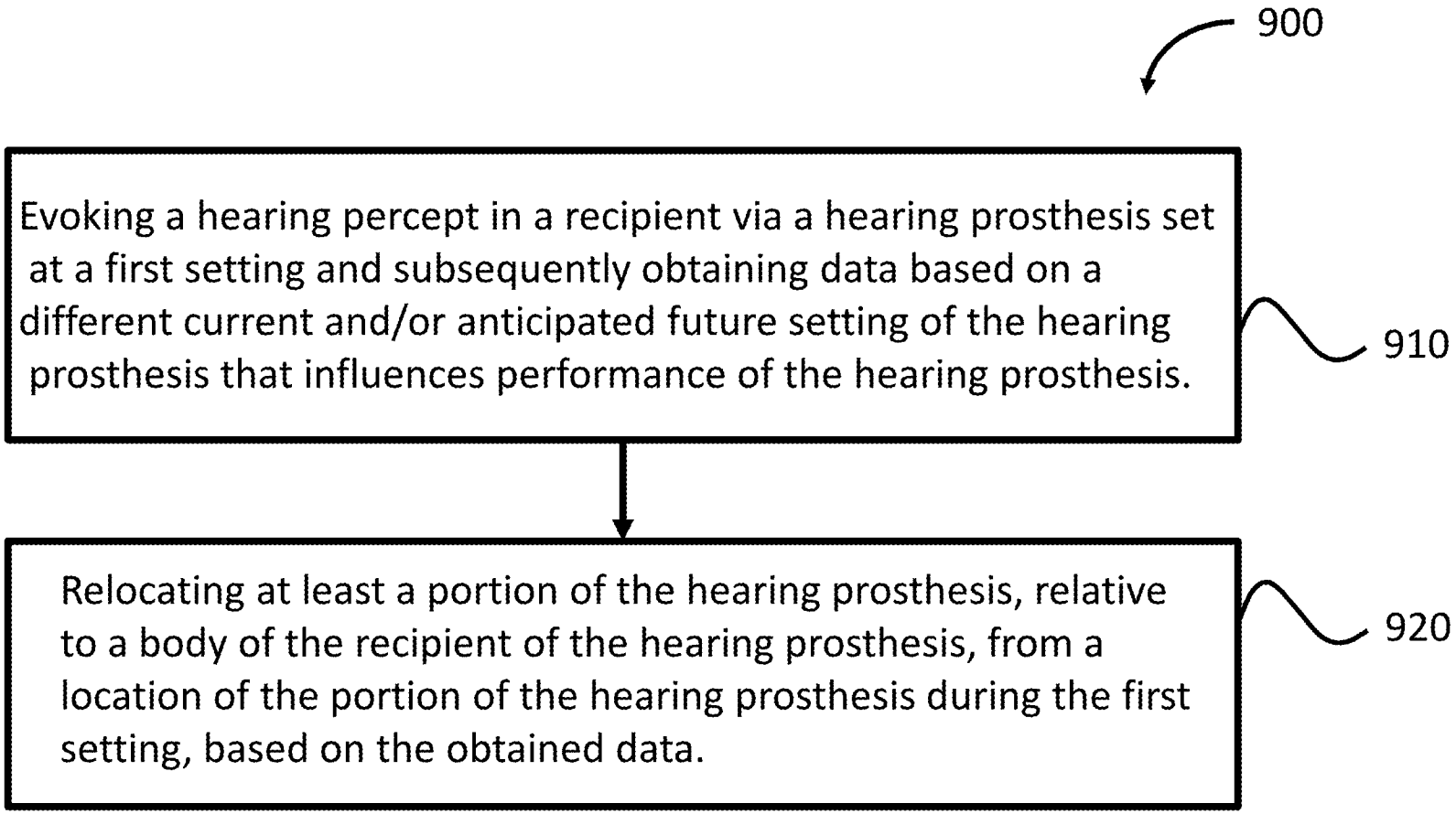
FIG. 9 is a flowchart for another exemplary method.

FIG. 9 depicts a flowchart for another exemplary method according to an exemplary embodiment, method 900. Method 900 includes method action 910, which entails evoking a hearing percept in a recipient via a hearing prosthesis set at a first setting and subsequently obtaining data based on a current and/or anticipated future setting of the hearing prosthesis that influences performance of the hearing prosthesis, wherein the current and/or future anticipated setting is different from the first setting. By way of example only and not by way of limitation, this first setting can be a setting correspond to a first gain level. In an exemplary embodiment of the method 900, the recipient has difficulty hearing speech with the hearing prosthesis set at this first gain level. The recipient determines that he or she should raise the gain level so as to, for example, increase the volume so that it is easier to hear what is being said, and does so, to a second gain level. The second gain level corresponds to the current and/or anticipated future setting of the hearing prosthesis that influences performance of the hearing prosthesis.

Method 900 further includes method action 920, which entails relocating at least a portion of the hearing prosthesis, relative to a body of the recipient of the hearing prosthesis, from a location of the portion of the hearing prosthesis where the hearing percept was evoked at the first setting, based on the obtained data. In an exemplary embodiment, this can entail moving the microphone away from the actuator of the hearing prosthesis. In an exemplary embodiment, by moving the microphone away from the actuator the hearing prosthesis, the likelihood of the occurrence of feedback is reduced because the transmission path has lengthened.

In this exemplary embodiment, the "obtained data" is in essence the determination that the gain should be adjusted, or has been adjusted subsequent the action of evoking the hearing percept in the recipient at the first setting. However, in other exemplary embodiments, this can entail an automatic procedure, where the obtained data is associated with a latent variable that indicates that the recipient intends to adjust the setting of the hearing prosthesis to a different setting or other data that indicates that the recipient is adjusting or has adjusted the hearing prosthesis. Still further, in other exemplary embodiments, this can entail a procedure where the prosthesis itself determines that a setting of the hearing prosthesis should be changed, and the obtained data is an output to the recipient that the setting has changed or will be changed in due course. By way of example only and not by way of limitation, in at least some exemplary embodiments, the hearing prosthesis has a system that can gauge when a recipient would desire to have a parameter changed, such as a gain increased and/or decreased (e.g., such as when the hearing prosthesis automatically determines that the recipient is listening to speech, music, is in an environment where there is a lot of background noise, etc.—various prior art devices enable such determination). The prosthesis could give an indication to the recipient that it intends to raise the volume or lower the volume or otherwise change the setting, in the recipient can act accordingly. By way of example only and not by way of limitation, an audio output of a synthesized voice can be provided to the recipient stating, for example, "volume to be raised." Any indication arrangement can be utilized in at least some exemplary embodiments. Depending on the familiarity of the system with the recipient, the recipient could understand that this means that the likelihood of feedback will be increased, for example. Thus, the recipient will relocate a portion of the hearing prosthesis, such as the microphone, based on this obtained data.

Note further that in an exemplary embodiment, the hearing prosthesis could simply automatically indicate to the recipient something like "move microphone away from implant." Providing that this data (the automatic indication to the recipient) is based on the current and/or anticipated future setting of the hearing prosthesis that influences performance of the hearing prosthesis, such as by way of example only and not by way of limitation, an increase in the gain of the hearing prosthesis, such data corresponds to the data of method 900.

Figure 10:
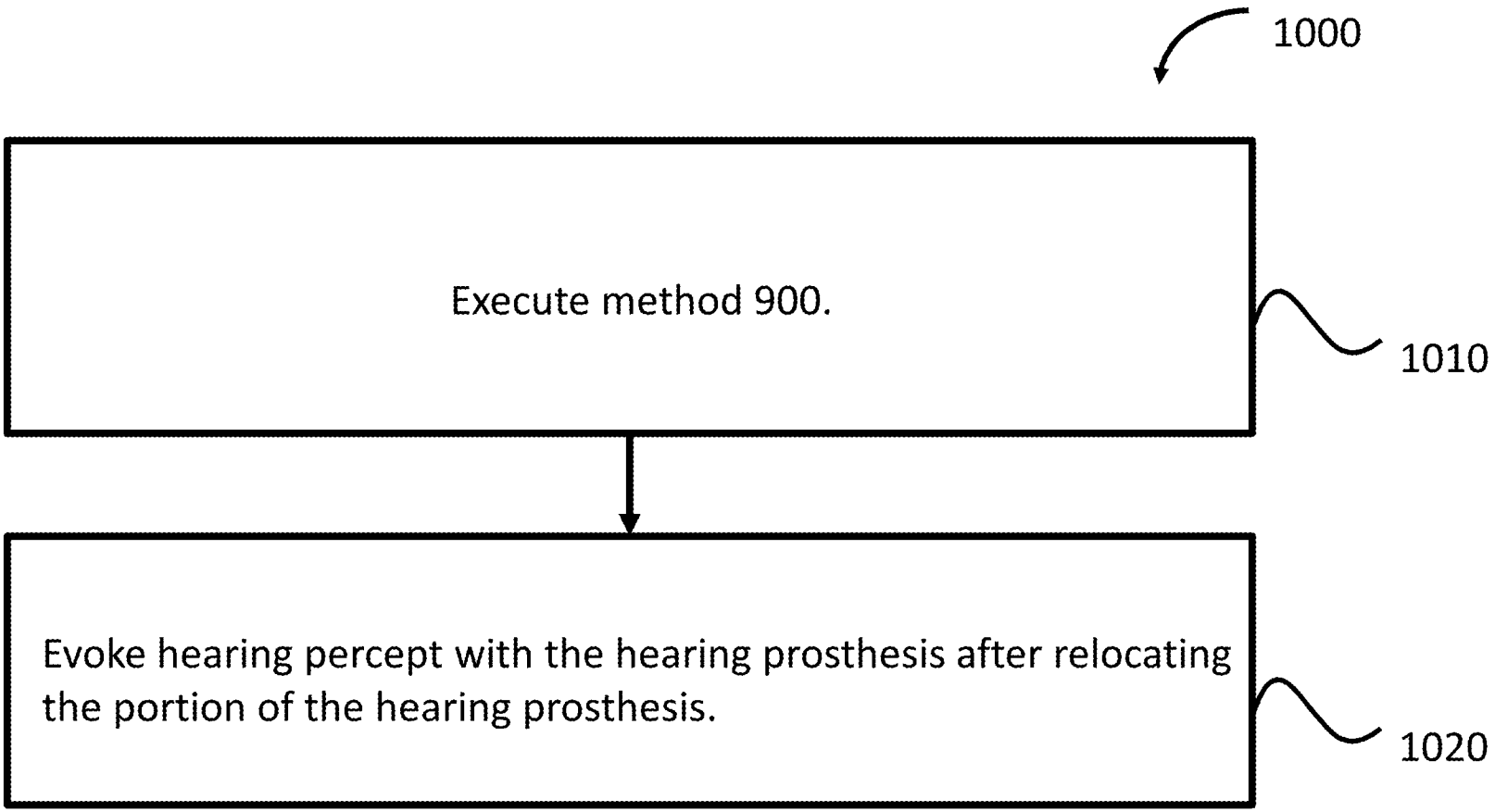
FIG. 10 is a flowchart for another exemplary method.

Still further, FIG. 10 depicts an exemplary flowchart for an exemplary method 1000, which includes method action 1010, which entails executing method 900. Method 1000 further includes method action 1020, which entails evoking a hearing percept with the hearing prosthesis after relocating the portion of the hearing prosthesis from the location of the portion of the hearing prosthesis where the hearing percept was evoked at the first setting.

In an exemplary embodiment of method 900, the current or anticipated future setting is a setting corresponding to an implementation of a feedback mitigation regime that is more aggressive in mitigating feedback relative to another feedback mitigation regime corresponding to the first setting. Such may be done in a scenario where, for example, processing power has been made available due to the deactivation, or otherwise lack of use of other processing intensive components. Such may be done in a scenario where, for example, battery power is more expendable (e.g., the recipient intends to utilize the prosthesis for only a limited amount of time relative to the next time the recipient will be the available to recharge the prosthesis). Such may be done in a scenario where, for example, the gain has been raised. In any event, regardless of the reason why, in an exemplary embodiment where the feedback mitigation regime is more aggressive than that which was the case corresponding to the first setting, a potentially wider range of positioning options becomes available to the recipient. For example, the recipient can more "safely" placed the microphone closer to the actuator and/or closer to the point of tissue stimulation relative to that which would be the case with the last aggressive feedback mitigation regime. Thus, the recipient might move the microphone from, for example, a position on a table remote from the recipient, too, for example, a position just above the ear via positioning of a BTE device. Note further that in some exemplary embodiments, the feedback regime aggression is reversed. That is, the new setting is the setting of last aggressive feedback mitigation.

Accordingly, in an exemplary embodiment, method action 920 is executed such that the action of relocating at least a portion of the hearing prosthesis entails moving a microphone of the hearing prosthesis closer to a location of tissue stimulation by the hearing prosthesis that evokes a hearing percept. Corollary to this is that in at least some embodiments, method action 920 is executed such that the action of relocating at least a portion of the hearing prosthesis entails moving a microphone of the hearing prosthesis to a location where the feedback is greater than at the location from which the portion of the hearing prosthesis is relocated.

Thus, in view of the above, in an exemplary embodiment of method 900, the current or anticipated future setting corresponds to a setting that results in the implementation that increases gain of the hearing prosthesis relative to the gain at the first setting. In an exemplary embodiment, the portion of the hearing prosthesis that is moved relative to the body of the recipient includes a microphone of the hearing prosthesis, wherein the movement of the portion entails moving the portion away from an implanted actuator of the hearing prosthesis that stimulates tissue.

Note further that in at least some exemplary embodiments, the actions of relocating the first portion of the hearing prosthesis can entail moving the microphone away from the actuator and/or the location of tissue stimulation. Also, while the embodiments up to this point have addressed moving the microphone, in some alternate embodiments, this can entail moving other portions of the hearing prosthesis, or the entire hearing prosthesis, or at least the portions thereof that can be moved by the recipient. By way of example only and not by way of limitation, with respect to the utilization of a passive transcutaneous bone conduction device in the soft band configuration, the passive transcutaneous bone conduction device can be moved to different locations about the head. Indeed, in at least some exemplary embodiments, the passive transcutaneous bone conduction device can be placed against the jaw instead of the mastoid bone. Any repositioning of the hearing prosthesis that will enable the teachings detailed herein and/or variations thereof to be practiced can be utilized in at least some exemplary embodiments.

Still with reference to FIG. 9 and method 900, in an exemplary embodiment, in the case of a current setting, the first setting is more compatible with the location of the portion of the hearing prosthesis prior to the relocation than the current setting, and the current setting more compatible with the relocated portion of the hearing prosthesis than the previous setting. Again by way of example only and not by way of limitation, the first setting could be a setting of relatively high gain as compared to the current setting, and the location prior to the relocation could be a location where the likelihood of the occurrence of feedback is reduced relative to that with respect to the relocated location. Also, with reference to method 900, in an exemplary embodiment, in the case of a future setting, the first setting is more compatible with the location of the portion of the hearing prosthesis prior to the relocation than the future setting, and the future setting is more compatible with the relocated portion of the hearing prosthesis than the current setting.

Conversely, in an exemplary embodiment, in the case of a current setting, the first setting is less compatible with the location of the portion of the hearing prosthesis after the relocation than the current setting, and the current setting is less compatible with the location of portion of the hearing prosthesis prior to relocation than the previous setting. Also, with reference to method 900, in an exemplary embodiment, in the case of a future setting, the first setting is less compatible with the location of the portion of the hearing prosthesis after the relocation than the future setting, and the future setting is less compatible with the location of the portion prior to relocation than the current setting.

The above has tended to focus on settings of a hearing prosthesis that are adjusted or otherwise changed on a generally routine basis. In alternate embodiments, the settings associated with method 900 (and the parameters adjusted in method 700, for that matter) can be settings associated with a map of the hearing prosthesis. In this regard, in an exemplary embodiment, the current and/or future setting is a setting corresponding to an implementation of a map from among a plurality of applicable maps stored in the hearing prosthesis. In this regard, there are exemplary embodiments of the hearing prosthesis where stored therein there are a plurality of maps that can be variously applied. By way of example only and not by way limitation, there are maps or programs that result in different hearing experiences for the same recipient for the same sounds for the same hearing prosthesis. These maps can be selected or deselected for implementation during the evocation of a hearing percept.

It is noted that the method of method 900 can have utilitarian value with respect to scenarios where a pertinent sound that is captured is desired to be enhanced by the recipient, but feedback would otherwise discourage such enhancement. By way of example only and not by way of limitation, there are scenarios where a recipient may want increased gain but cannot do this because of the feedback concerns. Thus, the recipient can move the microphone to a location where feedback is less likely to occur, thus permitting the gain to be increased. That said, in alternative embodiments, there are scenarios where the recipient does not necessarily need such gain, but would prefer to wear the pertinent prostheses at a given location. In this regard, the recipient can move the microphone to a location where feedback is more likely to occur where the given parameters of the hearing prosthesis are adjusted to account for the feedback or otherwise reduce the likelihood of feedback (e.g., gain is reduced relative to that which be the case where the microphones are located at other locations). For example, in a scenario where the recipient is in a city or otherwise is listening to music, if the recipient seeks to wear the hearing prosthesis microphones on his or her head, the recipient might reduce the gain of the system. That said, in alternate embodiments, the recipient can adjust or otherwise change a map of the hearing prosthesis from a first map to a second map. By way of example only and not by way of limitation, maps can be developed that are applicable to where the microphones are located during given wearing implementations. For example, a first map can be utilized for scenarios where the microphones are worn on the head, a second map can be utilized for scenarios where the microphones are worn on the chest, and a third map can be utilized for scenarios where the microphones are located remote from the body. This can be done automatically and/or manually in various embodiments.

It is noted that embodiments include devices and/or systems and/or apparatuses that are configured to implement one or more or all of the method actions detailed herein and/or variations thereof. Still further, in an exemplary embodiment, there is a device comprising a hearing prosthesis configured such that an operating parameter thereof is adjustable to account for a change in a location of at least a portion of the sound capture device relative to a recipient of the hearing prosthesis. In this regard, in an exemplary embodiment, the device can be a transcutaneous bone conduction device (or a middle ear implant—while the present application tends to focus on bone conduction devices, it is noted that the teachings detailed herein and/or variations thereof are also applicable to middle ear devices) that enables a feedback algorithm to be changed to account for a change in position of, for example, the microphone, or even the entire external component of the prosthesis for that matter. Thus, in an exemplary embodiment, there is a hearing prosthesis configured such that an operating parameter thereof is adjustable to account for a change in a location of a sound capture device relative to a tissue stimulating component of the hearing prosthesis. Of course, as has been detailed above, the change in location can be one that changes the feedback path, such as the feedback path between the tissue stimulating component and the microphone.

Figure 11:
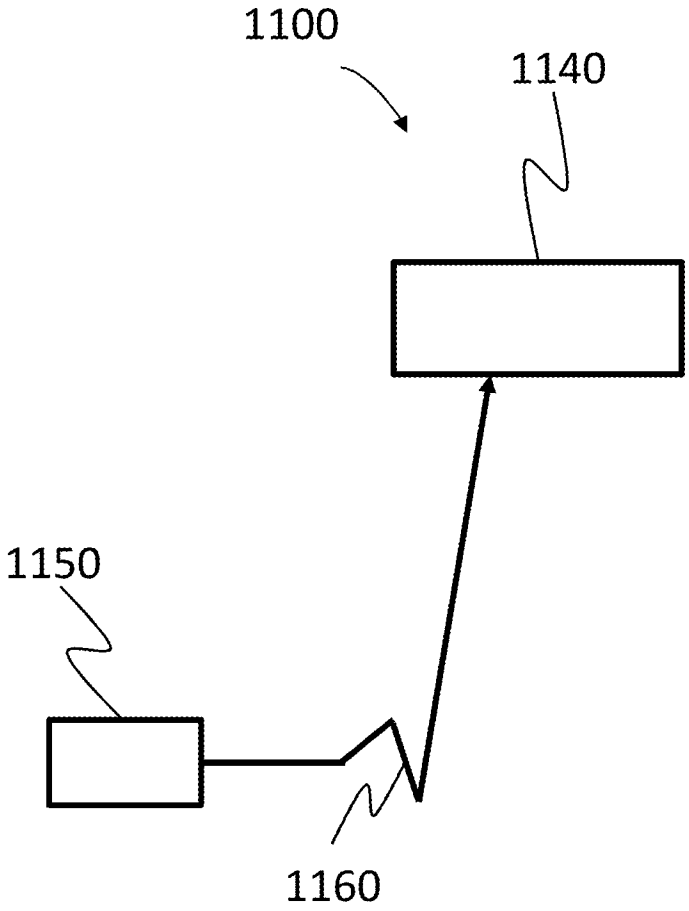
FIG. 11 is a functional diagram of an exemplary embodiment.

More specifically, FIG. 11 is a functional representation of an exemplary hearing prosthesis 1100, which can correspond to any of the hearing prosthesis is detailed herein and/or variations thereof. As can be seen, hearing prosthesis 1100 includes component 1140, and component 1150. Component 1150 is in signal communication with component 1140 via a link 1160. It is briefly noted that link 1160 can be a wired and/or a wireless link any device, system, and/or apparatus that can enable signal transmission between component 1150 and component 1140 can be utilized at least some exemplary embodiments of this exemplary embodiment.

As can be seen, component 1150 is movable relative to component 1140. In an exemplary embodiment, component 1150 corresponds to a component that includes a sound capture device, such as a microphone, of hearing prosthesis 1100. In an exemplary embodiment, component 1140 corresponds to a component that includes an actuator or the like that imparts stimulation to the recipient to evoke a hearing percept. In an exemplary embodiment, component 1150 can correspond to a behind-the-ear device, and component 1140 can correspond to the so-called "button portion" of the hearing prosthesis 1100, that is magnetically coupled via a transcutaneous magnetic link to an implanted magnet. In an exemplary embodiment, the behind-the-ear device 1150 is connected to the button portion 1140 via a flexible electrical cable having a length of about 3, 4, 5, 6, 7, 8, 9, 10, 11, 12, 13, 14, or about 15 cm. The button portion 1140 can include the actuator that vibrates in response to a sound captured by the microphone of component 1150. The vibration travels through the skin of the recipient, to the mastoid bone of the recipient (the component 1140 is located above the mastoid bone on the outside of the recipient), and the vibrations are conducted through the mastoid bone to ultimately reach the cochlea to evoke a hearing percept. It is noted that in an alternate embodiment, component 1140 does not include the actuator, but instead is an RF coil, such as an inductance coil, that transcutaneously communicates with an implanted inductance coil, that in turn is in communication with an actuator implanted in the recipient. An exemplary embodiment of this can include the hearing prosthesis detailed above with respect to FIGS. 2A to 2C. That said, in an alternate embodiment, the hearing prosthesis can correspond to an active transcutaneous bone conduction device, where implanted RF coil is in signal communication with an implanted actuator, such as electromagnetic actuator.

The point is that the microphone in the embodiment of FIG. 11 can be moved relative to the actuator and/or location of tissue stimulation by the hearing prosthesis. Accordingly, in at least some exemplary embodiments of the embodiment of FIG. 11, the change in location changes a feedback path between the tissue stimulating component and/or the location where the tissue is stimulated, and the microphone.

In at least some exemplary embodiments of this exemplary embodiment, the hearing prosthesis 1100 includes at least a first feedback algorithm and a second feedback algorithm different from the first feedback algorithm, wherein the hearing prosthesis is configured to be adjusted to utilize the first feedback algorithm in a first scenario and to utilize the second feedback algorithm in the second scenario. In an exemplary embodiment, this adjustment corresponds to the adjustment of the above-noted operating parameter. In an exemplary embodiment, this can have utilitarian value in that the feedback algorithm can be changed depending on the feedback path that is expected to exist or otherwise, statistically speaking based on the empirical evidence, is likely to exist with respect to movement of component 1150 relative to component 1140 (or, with respect to embodiments where the entire prosthesis is moved, or at least the entire external component of the prosthesis is moved, the feedback algorithm can be changed depending on the feedback path that is expected to exist or otherwise, statistically speaking based on the empirical evidence, is likely to exist with respect to movement of the entire hearing prosthesis relative to a given location on the recipient's body).

In this regard, by way of example, method 500 and/or method 550 can be executed so as to develop data and/or a regime of parameters (including parameter changes) so as to accommodate or otherwise address the fact that the hearing prosthesis and/or portions thereof can be located at different locations, and thus the feedback path will change, which parameters/parameter changes can be utilized in the embodiments detailed herein. Accordingly, some or all of the method actions detailed herein and/or variations thereof can be utilized in conjunction with method 500 and/or method 550. By way of example, method 500 can be utilized as a precursor to the various other methods detailed herein, where method 500 can be utilized to develop the empirical data upon which the various changes and/or adjustments are based. For example, method action 520, which entails determining one or more feedback path parameters of the hearing prosthesis based on the operation of the adaptive system of the hearing prosthesis can be utilized to determine or otherwise identify a utilitarian parameter of the hearing prosthesis that can be implemented for a given location. In this regard, method 500 can be executed repeatedly for the various different locations associated with the various wearing implementations. The data resulting from the execution of method 500 can then be utilized to develop the parameters for the different wearing regimes. In a similar vein, method 550 can be utilized to develop the data and/or the regime of the parameter changes so as to accommodate or otherwise address the fact that the hearing prosthesis and or portions thereof can be located at different locations. In this regard, as noted above, method 550 can be executed in an iterative manner so as to identify a given set of functional parameters of the prosthesis that will just avoid the feedback, while maximizing the utilitarian value of the hearing prosthesis.

It is noted that some exemplary embodiments include the modeling/simulation of feedback loops for respective wearing implementations to develop a database or otherwise baseline of data. This baseline of data/database can be utilized to develop feedback management regimes that can be implemented corresponding to the various wearing implementations. By way of example only and not by way of limitation, the ease of various models/simulations can be utilized to develop the amount of delay that is input into the system via delay circuit 474. Of course, in some alternate embodiments, actual empirical data can be utilized for a given particular recipient and/or for particular environments. By way of example only and not by way limitation, a variety of subjective regimes can be developed for the various wearing implementations for a particular person. That said, a hybrid of this can be developed—statistically significant data for a given populace can be utilized, in general terms, and more specific data can be utilized for specific person. By way of example only and not by way of limitation, the feedback regimes can be different whether a 5 foot 10 inch person weighs 150 pounds or 250 pounds. Accordingly, the adjustment of the parameters can be made based on various modeling's and/or simulations but tailored to a specific body type for implementation into the hearing prosthesis.

As noted above, in some exemplary embodiments, a parameter (e.g., operating parameter) of the hearing prosthesis is a number of filter taps utilized in a feedback algorithm of the hearing prosthesis. Accordingly, in at least some exemplary embodiments, the hearing prosthesis 1100 is configured to increase and decrease the number of filter taps to accommodate the change in location of the at least a portion of the sound capture device. As noted above, in at least some exemplary embodiments, depending on the feedback path distance, a number of filter taps may be "wasted" in a scenario where the prosthesis is trying to implement feedback mitigation or feedback management based on "presumed" temporal periods of the feedback reaching the microphone that are shorter than that which is actually the case. Still further, in an exemplary embodiment, the device can be configured such that the adaption speed and/or the step size of the feedback management system is adjustable to accommodate different locations of the microphone relative to the actuator and/or relative to the point of tissue stimulation and/or relative to the recipient's body. In an exemplary embodiment, this can be performed automatically by the hearing prosthesis (i.e., the hearing prosthesis is configured to do this automatically, if only due to a generalized input into the hearing prosthesis as to the location of the microphone relative to another pertinent location—this could be via an input by the user, and/or via the prosthesis itself sensing or otherwise extrapolating from latent variables the location of the microphone or other pertinent components relative to another pertinent location). In an alternate embodiment and/or in addition to this, this can be performed manually by the recipient of the hearing prosthesis. Any device, system, and/or method that can enable the number of filter taps and/or adaptation speed, etc., of the hearing prosthesis to be changed can be utilized in at least some exemplary embodiments.

Note further that in at least some exemplary embodiments, the parameters of the hearing prosthesis can be adjusted based on what can be analogized to as a first-order derivative of the movements. For example, instead of adjusting the parameters based on the fact that a portion of the hearing prosthesis has been located to location from another location, the parameters can be adjusted based on one how frequently the portion will be moved within a given temporal period. By way of example only and not by way of limitation, if the microphone will be frequently moved to two or three different locations within a relatively short period of time, the hearing prosthesis may be adjusted so that the pertinent parameters are a hybrid of those that would be optimized for the individual locations. Alternatively, in another exemplary embodiment, the parameters that are adjusted in the hearing prosthesis are directed towards those that minimize feedback or otherwise enhance the utilization of the hearing prosthesis for the "worst case scenario." For example, if the utilization of the hearing prosthesis in the button sound processor scenario where the microphone is closest to the actuator causes the greatest increase for the risk of feedback, the parameters associated with mitigating or otherwise minimizing feedback for that scenario will apply even though the location of the microphone might be moved to other locations that would be less likely to generate feedback, providing that such is done within a given period of time.

In a similar vein, at least some exemplary embodiments are directed towards the changing environments of the hearing prosthesis. If, for example, movements of the recipient results in temporally brief but periods of feedback nonetheless (e.g., if the recipient raises his or her hand frequently, etc.) the parameter the hearing prosthesis can be adjusted to account for such.

Still further, some exemplary embodiments can utilize sound classifiers/the classification of sound, as an indicator of how the hearing prosthesis is being worn. By way of example only and not by way of limitation, a recipient may, in a statistically significant manner, more frequently wear the hearing prosthesis in a given wearing implementation when the recipient is exposed to a first sound environment (e.g., listening to music), and the recipient may, in a statistically significant manner, more frequently wear the hearing prosthesis in another given wearing implementation when the recipient is exposed to a second sound environment (e.g., speech). The hearing prosthesis can be configured to identify or otherwise classify the sound environment, and extrapolate based on that sound that the recipient has likely changed the wearing implementation or otherwise is using a given wearing implementation corresponding to that which he or she generally prefers or otherwise statistically speaking, utilizes for that given environment. In an exemplary embodiment, the hearing prosthesis can be configured to provide an indication to the recipient to "ask" the recipient whether or not he or she seeks to utilize a given parameter for that wearing implementation. In an exemplary embodiment, the hearing prosthesis can automatically change this parameter and/or can indicate to the recipient that the hearing prosthesis will automatically change the parameter within a given period of time, such as, for example, two, three, four seconds etc., unless the recipient overrides that change.

Corollary to this is that in an exemplary embodiment, the classification of sound can permit the prosthesis to determine where the microphones are located. In this regard, scenarios can exist where, in a statistically significant manner, certain frequencies of sound captured by the microphones have higher or lower magnitudes or otherwise are more or less present for certain wearing regimes relative to other wearing regimes. By way of example only and not by way of limitation, lower frequencies are more readily radiated from the skull. Accordingly, the prosthesis can be configured to determine or otherwise evaluate the received sounds from the given microphones, and determine, based on the frequencies, that the microphones are being utilized near to the recipient's head. Thus, the prosthesis can implement or otherwise change a parameter, automatically, based on a determination that the lower frequencies are more heavily present, thus indicating that the microphones are being worn at a location of the skull.

In view of the above, in an exemplary embodiment, there is a hearing prosthesis that is a bone conduction device. This bone conduction device is configured to have at least one of the following features "A" or "B": (A) the ability to allow a user to adjust a feedback control regime of the hearing prosthesis, based on whether the hearing prosthesis is used as at least two of: (i) a passive transcutaneous bone conduction device magnetically coupled to an implanted component; (ii) a percutaneous bone conduction device; or (iii) a passive transcutaneous bone conduction device compressively retained to the recipient (such as, by way of example only and not by way of limitation, in the manner that results from the use of a so-called soft band system, or that which results from the recipient simply holding a portion of the hearing prosthesis against the skin of the recipient); or (B) automatically adjust a feedback control regime of the hearing prosthesis based on whether the hearing prosthesis is used as at least two of: (i) a passive transcutaneous bone conduction device magnetically coupled to an implanted component; (ii) a percutaneous bone conduction device; or (iii) a passive transcutaneous bone conduction device compressively retained to the recipient. Again, by way of example only and not by way of limitation, with respect to feature "A," this could be the ability of the recipient to input how the device is being used (i, ii, or iii), where the prosthesis uses that input to adjust the feedback control regime. Still further, by way of example only and not by way of limitation, with respect to feature "A," this could be the ability of the recipient to actually adjust the prosthesis to implement the specific feedback control regime from a plurality of feedback control regimes. In an exemplary embodiment, as noted above, the so-called smart phone can have an application that will permit such adjustment via the recipient. Alternatively, and/or in addition to this, a main component of the prosthesis, such as the so-called sound processor of the percutaneous bone conduction device, can have an interface that permits the recipient to change or otherwise adjust the feedback control regime. With respect to feature "B," this could be implemented via the prosthesis itself determining how it is being used (which of i-iii), whether directly or via latent variables.

As noted above, some exemplary embodiments are directed towards the adjustment of gain of the hearing prosthesis to accommodate a change in location of a component of the hearing prosthesis that changes the feedback path. Accordingly, in an exemplary embodiment, hearing prosthesis 1100 is configured to adjust a gain of the system to accommodate the change in location, wherein the change in location substantially impacts a feedback loop of the hearing prosthesis. In an exemplary embodiment, this adjustment of the gain is automatic, and can be performed upon a determination, or otherwise inputted into the system that the change in location of the given pertinent component, such as a microphone, has occurred. It is noted that this automatic adjustment can be a result of a manual input by the recipients that the change in location has occurred, at least in some exemplary embodiments. In other exemplary embodiments, the two not being mutually exclusive, this automatic adjustment can be a result of the hearing prosthesis sensing or otherwise determining that the change in location has occurred.

It is noted that many of the teachings detailed above address feedback management vis-à-vis the change in location of some or all portions of the hearing prosthesis. In some other embodiments, again which are not mutually exclusive, the adjusted parameter that is adjusted as a result of a given change in location of a pertinent component is a parameter that influences a feature of the hearing prosthesis that is not related to feedback management and/or only tangentially related to feedback management. By way of example only and not by way of limitation, in an exemplary embodiment, the adjusted parameter is a parameter that influences a wind noise management system of the hearing prosthesis. In this regard, in an exemplary scenario, placement of the sound capture device at a location in front of the recipient, such as, for example, at the chest of the recipient, will change the effect of wind noise on the hearing prosthesis relative to that which would be the case if the sound capture device was located proximate the outer ear of the recipient and/or in back of the ear of the recipient (such as can be the case in the embodiments corresponding to the so-called button sound processor as noted above), and combinations thereof. Accordingly, in an exemplary embodiment, the action of adjusting the parameter in method 700 corresponds to adjusting a parameter that influences a noise management system of the hearing prosthesis. As with the various other embodiments detailed herein, adjustment can include the activation and deactivation of the wind noise management system. Corollary to this (i.e., embodiments directed towards non-feedback specific related features) is that in an exemplary embodiment, the adjusted parameter of method 700 is a parameter that influences a directionality system of a sound capture system of the hearing prosthesis. In this regard, in at least some exemplary embodiments, the hearing prosthesis 1100 is configured with a so-called beamforming system that permits the prosthesis to focus the sound capture system in a specific direction (e.g., towards the front, such as in a scenario where the recipient is speaking to someone) which permits so-called omnidirectional sound capture. In at least some exemplary embodiments of hearing prostheses that have such directionality abilities, the hearing prosthesis is configured to adjust (which includes activation and/or deactivation of a device, system and/or routine, etc.) a parameter that influences the directionality system of the sound capture system of the hearing prosthesis. By way of example only and not by way limitation, if the wearing implementation corresponds to, for example, wearing the pertinent portion of the hearing prosthesis (e.g., the portion with the microphone) on the chest or the like, omnidirection mode will likely be implemented. If the pertinent portion of the hearing prosthesis is worn above the ear or the like, another regime might be used, such as a beamforming mode that focuses sound capture towards a given direction.

To be clear, in an exemplary embodiment, any of the hearing prostheses detailed herein and/or variations thereof can include a feedback delay circuit 474 as detailed above or otherwise the methods detailed herein include the utilization of a feedback delay circuit or any other device, system, and/or method that will enable bulk delay in the feedback delay line path extending from the signal that is outputted by the processor 436. In an exemplary embodiment, the feedback management signal delay can be varied by the delay circuit 474 to correspond to a utilitarian delay for a given wearing regime/wearing implementation.

Still further, with respect to FIG. 4, which details that there are multiple microphones in a given prosthesis, it is noted that feedback will arrive at different times with respect to different microphones, at least when such microphones are located at different distances from the actuator and/or the location of tissue stimulation, or at least when the medium through which the feedback passes has a different density or otherwise is such that will vary the speed of the vibrational energy returning back to the microphones. While the embodiment of FIG. 4 depicts a left and right microphone 242L and 242R, it is noted that for the purposes of discussion here, the concepts that will now be articulated, the microphones can correspond to the microphones located on a given button, such as a button sound processor, or a given behind the ear device, etc., where the multiple microphones are utilized for beamforming or the like. That said, it is also noted that for the purposes of discussion here, the left and right microphones are also applicable to the concepts that will now be articulated. In this regard, microphones of a beamforming system can be arrayed such that one or more microphones are closer to the "front" than other microphones/the microphones have a different distance from the "front." In this regard, the word "front" refers to the front of the recipient, which is often where a source of voice that is captured by the hearing prosthesis is generated. It will be understood that the teachings detailed herein and/or variations thereof are applicable to other locations. Corollary to this is that when the portion of the microphone containing one or more or all of the pertinent microphones is moved relative to the actuator and/or relative to a location of tissue stimulation to evoke a hearing percept, or even, in at least some instances, where the entire external component of the hearing prosthesis is moved, the feedback paths/the feedback distances will be different for the different microphones, and can be variously different for the various microphones individually, and thus the timing of the feedback arriving at the various microphones can be different from microphone a microphone.

By way of example only and not by way of limitation, in an example where the movement of the microphones results in the microphone that was previously closest to the actuator and/or closest to the location of tissue stimulation being furthest from the actuator and/or furthest from the location of tissue stimulation, and the microphone that was previously furthest from the actuator and/or furthest from the location of the tissue stimulation being closest to the actuator and/or closest to the location of tissue stimulation, the feedback timing will be both qualitatively (reversal of which microphone receives the "first" feedback) and quantitatively (different times) temporally different in potentially a substantive manner. Accordingly, in an exemplary embodiment, there are devices, systems, and/or methods that will enable the adjustment of parameters of the hearing prosthesis to account for this phenomenon.

While many aspects detailed above have focused on the temporal nature of the feedback, other exemplary embodiments (which embodiments are not mutually exclusive) focus on feedback management with respect to the frequency of the feedback. In this regard, it is noted that depending on the locations of the microphone with respect to a given wearing implementation, the frequencies associated with feedback may be different relative to other wearing regimes. By way of example only and not by way limitation, a first wearing regime may result in feedback being primarily concentrated in the lower frequencies relative to other frequencies and/or may result in feedback being enhanced by a greater amount in lower frequencies relative to that which would be the case for those frequencies in the other wearing implementations and/or by a greater amount than those of other frequencies at this different location. In any event, the idea here is that different locations can have, in some scenarios, a "feedback driver" that that is concentrated or otherwise appointed in frequencies to others. Thus, some exemplary embodiments are directed towards adjusting parameters depending on the locations in a manner that addresses the "feedback drivers" so that the other frequencies which may not necessarily create feedback in the respective locations are provided to the recipient in a manner that enhances the hearing of those frequencies or otherwise enables the recipient to hear more content of those frequencies than that would otherwise be the case in a scenario where the parameters that are adjusted are applied across the board to all frequencies.

By way of example only and not by way of limitation, the magnitude of the feedback within certain frequency bands may change or otherwise may be different for different wearing implementations. Accordingly, in an exemplary embodiment, there is an exemplary method where the pre-filtering or otherwise other types of filtering is set or otherwise adjusted depending on the frequency regions that create feedback or otherwise create more of the feedback or otherwise create most of the feedback or otherwise create a feedback scenario that impacts the hearing prosthesis in the first instance (i.e., it is only certain frequencies that cause the feedback, or at least noticeable feedback, that impacts the hearing prosthesis). Accordingly, in an exemplary embodiment, the action of adjusting a parameter of the hearing prosthesis in method 700 detailed above entails adjusting a pre-filter arrangement to filter certain frequencies relative to that which was filtered (including the absence of filtering) during a previous evocation of a hearing percept, etc. By way of example only and not by way of limitation, in an exemplary embodiment, in a scenario where the microphone(s) are worn on the chest or the like, which will result in a larger bandwidth of the captured sounds (i.e., lower frequencies will be captured), more aggressive filtering of some frequencies, such as the higher frequencies, relative to that which would be the case, for example, if the microphone is worn on the head, might be implemented relative to that which was the case when the microphone was worn proximate the ear, where the bandwidth will be smaller, and vice versa. For example, this can be implemented by the activation of a high-pass filter and/or a low pass filter, depending on the frequencies at issue, and, corollary to this, the deactivation of a high-pass filter and/or a low pass filter in a different wearing scenario.

To be clear, in an exemplary embodiment, direct sound, sound coming from the sound source, in front, without reflections via the walls, in some embodiments, will be more dominant when the microphone is worn on the chest when an omni directional mode is used compared to when worn on the ear. When worn on the chest, a forward facing directionality will be achieved because sound from the rear, including reflections, will be attenuated by the body in at least some embodiments. Thus, in some exemplary embodiments, there will be less low frequency intensity in the incoming signal when the device is worn on the chest as compared to, for example, worn on the head, at least in scenarios where room reflections will be attenuated more so (the intensity of room reflection noises are often more generally found to be higher in the lower frequencies). Thus, in an exemplary embodiment, in terms of feedback, the attenuation of the feedback signal can be much larger when worn on the chest, further away from the transducer, which, in some embodiments, allows for a broader bandwidth of high gain to be applied without feedback limitations. Thus, an exemplary embodiment entails utilizing a higher gain for the lower frequencies with respect to wearing implementations where the microphone is worn on the chest relative to that which would be the case with respect to a wearing implementation where the microphone was located on or otherwise proximate the head.

In some exemplary embodiments, such as those where the microphones are worn proximate to the skull, the skull radiates vibrations at a lower frequency, and thus the feedback that is received by the microphones that are proximate the skull will have a feedback driver at the lower frequencies. Accordingly, in an exemplary embodiment, the hearing prosthesis can filter or at least partially the frequencies with respect to the signal from processor 436 that is "fed back" to summer 435, at least more than other frequencies. In an exemplary embodiment, it is noted that with respect to at least some of the hearing prostheses detailed herein, it is at the higher frequencies where most of the feedback occurs. Accordingly, an exemplary embodiment entails filtering the signal from 436 that is fed back to the summer 435 such that the amount of signal that is present with respect to the higher frequencies, middle frequencies or lower frequencies (the amount of signal that is available it will be used to cancel out the feedback), depending on the wearing implementation (or all frequencies) is variable depending on the location of the microphones.

If feedback occurs at the lower frequencies, the higher frequencies and middle frequencies can be filtered out in a feedback path model so that the algorithm does not affect such frequencies. That is, the frequencies that are not causing feedback should be provided to the recipient, in at least some exemplary embodiments, at the maximum gain desired by the recipient.

Accordingly, in an exemplary embodiment, there are methods and there are hearing prosthesis configured to focus the filtering/cancellation (which can include partial cancellation—instead of a complete elimination of sound at this frequencies, the gain at those frequencies can be reduced by a percentage that will avoid or otherwise mitigate feedback) with respect to frequencies where feedback occurs with respect to a given wearing implementation.

In an exemplary embodiment, there is a device, system, and/or method of managing feedback, which entails variously filtering frequencies and/or cancelling sound containing frequencies at or around 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3250, 3500, 3750, 4000, 4250, 4500, 4750, 5000, 5250, 5500, 5750, 6000, 6500, 7000, 7500, and/or 8000 Hz, or any value or range of values therebetween in about 1 Hz increments.

Figure 12:
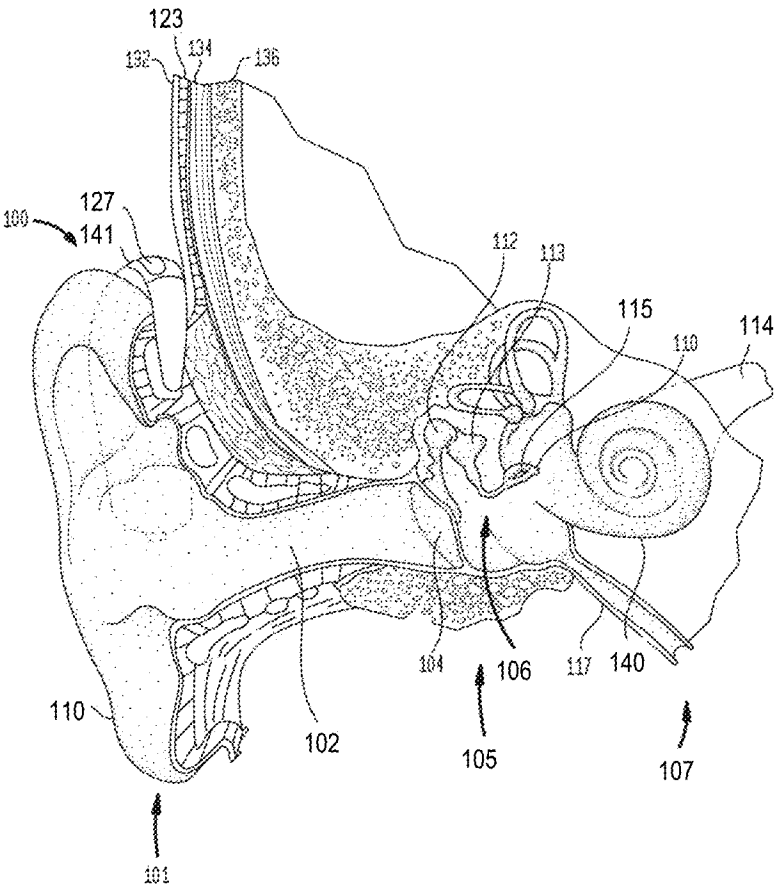
FIG. 12 is a schematic of another exemplary embodiment in which some exemplary teachings can be implemented.

As noted above, some exemplary embodiments of the teachings detailed herein can be implemented in a so-called split system, where the actuator is located remote from a BTE device, where the BTE device includes a microphone. In this regard, FIG. 12 is a perspective view of a passive transcutaneous bone conduction device 100 in which embodiments may be implemented. FIG. 12 illustrates the positioning of the device 100 relative to outer ear 101, middle ear 102 and inner ear 106 of a recipient of device 100. As shown, bone conduction device 100 is positioned behind outer ear 101 of the recipient. Bone conduction device 100 comprises an external component 141 in the form of a behind-the-ear (BTE) device.

BTE device 141 typically comprises one or more sound input elements 127, such as microphone, for detecting and capturing sound, a sound processing unit/sound processor (not shown) and a power source (not shown). Bone conduction device 100 includes an actuator (not shown in FIG. 12, but depicted in FIG. 13, described below, although in some embodiments, the actuator is located within the body of the BTE device).

Figure 13:
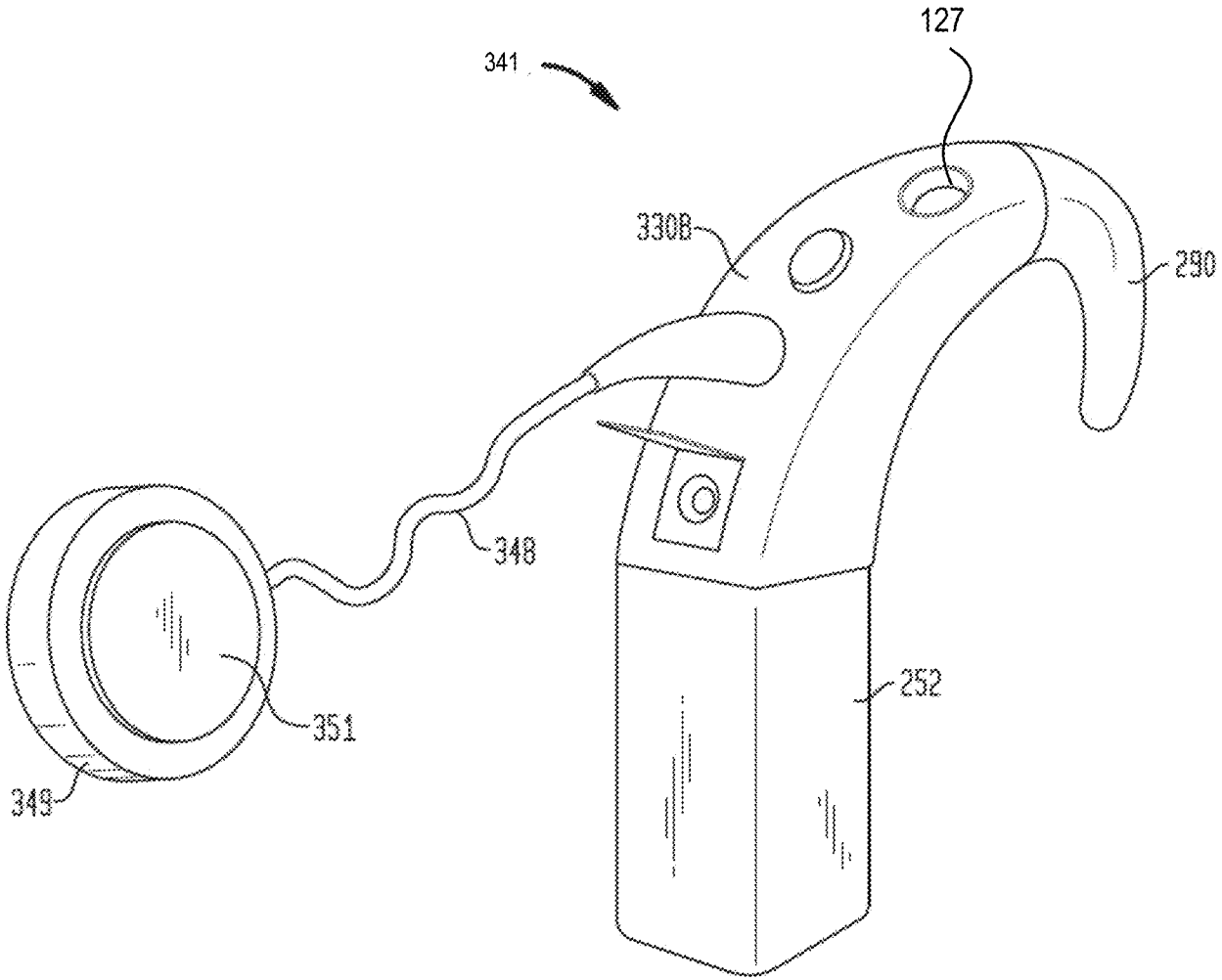
FIG. 13 is a schematic of additional details of the embodiment of FIG. 12.

In an exemplary embodiment, sound input element 127 may be located remote from the BTE device 141 and may take the form of a microphone or the like located on a cable (as seen in FIG. 13 discussed below) or may take the form of a tube extending from the BTE device, etc. In this regard, it is noted that in at least in some exemplary embodiments, the microphone of the BTE device can be movable relative to the body of the BTE device and/or relative to the recipient so as to implement at least some of the exemplary embodiments detailed herein.

FIG. 13 depicts additional details of bone conduction device 100, depicting BTE device 341, and a remote vibrator actuator unit 349 (sometimes referred to as a "button" in the art) containing vibrating actuator corresponding to the vibrational component detailed above with respect to the passive transcutaneous bone conduction device. This as opposed to embodiments where the vibrator actuator is located in the spine 330B. Vibrator actuator unit 349 is in electronic communication with spine 330B via cable 348. Spine 330B can house a sound processor, and supports microphone 127, although in other embodiments, the microphone 127 can be located on the ear hook 290 (or a plurality of microphones can be so located). In this regard, microphone 127 captures sound, and transduces the sound into an electrical signal that is provided to a signal processor housed within the spine 330B, where battery 252 is removably attached thereto. The signal processor processes the signals, and outputs electrical signals that are transferred to the vibrator actuator in vibrator actuator unit 349, via cable 348, which vibrations are transferred to the recipient in a manner analogous to the embodiment detailed above with respect to FIG. 1B. Vibrator actuator unit 349 may include a coupling 351 to removably attach the unit 349 to outer skin of the recipient. Coupling 351 can correspond to the couplings detailed herein. Such a coupling may include, for example, adhesive. Alternatively and/or in addition to this, coupling 351 can correspond to a magnet that couples via magnetic attraction to an implanted magnet within the recipient (e.g., an implanted magnet attached to the mastoid bone of the recipient underneath the skin of the recipient).

While the embodiment depicted in FIG. 13 utilizes a cable 348 to communicate with the remote vibrator actuator unit 349, in an alternative embodiment, a wireless link is utilized to communicate between the spine 330B and the remote vibrator actuator unit 349.

In at least some exemplary embodiments, the remote vibrator actuator unit 349 can contain a sound processor/sound processing unit or the like as opposed to and/or in addition to the spine 330B. Accordingly, in an exemplary embodiment, the remote vibrator actuator unit 349 can be a button sound processor. Still further, the remote vibrator actuator unit 349 can include one or more microphones.

Indeed, in an exemplary embodiment, the recipient can choose between utilizing the microphones located on the remote vibrator actuator unit 349 as compared to those of the BTE device 341. Corollary to this is that in some exemplary embodiments, the remote vibrator actuator unit 349 can correspond to a separately independent removable component of the transcutaneous bone conduction device, such as in embodiments where the remote vibrator actuator unit 349 includes its own sound processor and microphones. Accordingly, in an exemplary embodiment, a first wearing implementation can correspond to utilizing the remote vibrator actuator unit 349 without the BTE device. A second wearing implementation can correspond to utilizing the remote vibrator actuator unit 349 with the BTE device. In this latter wearing implementation, the microphone of the BTE device, microphone 127, can be utilized instead of and/or in addition to the microphone(s) of the remote vibrator actuator unit 349.

In view of the above, it is to be understood that in an exemplary embodiment of the bone conduction device 100, different wearing implementations, such as with or without the BTE device, can result in a different distance is and/or different feedback paths between the actuator and/or the location of tissue stimulation and the given microphone.

Moreover, as noted above, in an exemplary embodiment, the recipient can choose between utilizing the microphones located on the remote vibrator actuator unit 349 as compared to those of the BTE device 341. In this regard, such changes the wearing implementation of the hearing prosthesis with respect to the specific microphone being utilized for sound capture the output of which is utilized by the sound processor. Corollary to this is that in at least some exemplary embodiments, any of the hearing prostheses detailed herein can include additional microphones than those detailed herein, and the utilization of different microphones, where the different microphones are located at different locations relative to the recipient and/or relative to the actuator and/or relative to the location of tissue stimulation relative to one another can correspond, to changing a wearing implementation of the hearing prosthesis. In this regard, in an exemplary embodiment, with respect to the percutaneous bone conduction device of FIG. 1A, and additional microphone system including a cable can be utilized, where the recipient variously plugs the cable into the external component 100A. Thus, the recipient can alternatively add an additional microphone beyond microphone 124A. Owing to the fact that the microphone is on a cable, if the hearing prosthesis utilizes output from that microphone as the basis to evoke a hearing percept, the feedback path between the microphone and the location of tissue stimulation and/or the actuator will be different. Accordingly, plugging the additional microphone system into the external component 100A can correspond to a change in the wearing implementation of the hearing prosthesis.

Indeed, in an exemplary embodiment, the recipient can choose between utilizing the microphones located on the remote vibrator actuator unit 349 as compared to those of the BTE device 341. In this regard, such changes the wearing implementation of the hearing prosthesis with respect to the specific microphone being utilized for sound capture the output of which is utilized by the sound processor.

In an exemplary embodiment, there is a method, comprising: obtaining data based on a current and/or anticipated future wearing implementation of a hearing prosthesis; adjusting a parameter of the hearing prosthesis based on the current or anticipated future wearing implementation of the hearing prosthesis; and evoking a hearing percept using the hearing prosthesis with the adjusted parameter. In an exemplary embodiment of the method, the current and/or anticipated future wearing implementation of the hearing prosthesis is a wearing implementation of a passive transcutaneous bone conduction device where sound is captured at a microphone that is part of a BTE device instead of a microphone supported by a housing that contains a vibrator of the passive transcutaneous bone conduction device. In an exemplary embodiment of the method, the current and/or anticipated future wearing implementation of the hearing prosthesis is a wearing implementation of a percutaneous transcutaneous bone conduction device where sound is captured at a microphone that is remote from a housing containing a vibrator instead of a microphone supported by the housing. In an exemplary embodiment of the method, the adjusted parameter is a frequency filtering regime of the hearing prosthesis.

In an exemplary embodiment, there is a device, comprising: a hearing prosthesis configured such that an operating parameter thereof is adjustable to account for a change in a location of at least a portion of the sound capture device relative to a recipient of the hearing prosthesis. In an exemplary embodiment of this device, the hearing prosthesis is configured to adjust a gain of the system to accommodate the change in location, wherein the change in location substantially impacts a feedback loop of the hearing prosthesis. In an exemplary embodiment of this device, the hearing prosthesis is configured to adjust a delay of a feedback algorithm to accommodate the change in location.

It is noted that any device and system detailed herein corresponds to a disclosure of a method of utilizing the device and a method of making that device. Any method detailed herein including method actions of any method detailed herein corresponds to a device that is configured to implement or otherwise execute one or more or all of the method actions detailed herein. Any method of making or otherwise producing a device as detailed herein corresponds to a disclosure of a resulting product from those method actions. Any embodiment detailed herein can be combined with any other embodiment detailed herein in at least some exemplary embodiments. Any method action that is detailed herein also corresponds to a disclosure of a method where that method action is automatically implemented. Corollary to this is that any such disclosure corresponds to a processor or a device that is configured to automatically implement such method actions. By way of example only and not by way of limitation, the present disclosure includes processors that are specially programmed to implement one or more or all of the method actions detailed herein or otherwise to have the functionality of the apparatuses detailed herein.

Note further that any disclosure herein of a method of manufacture corresponds to a disclosure of a device resulting from that method of manufacture.

It is further noted that some embodiments according to the teachings detailed herein include a non-transitory computer readable medium having recorded there on a computer program for executing one or more of the method actions detailed herein and/or variations thereof, which computer program, when executed, causes a machine to perform in a given manner. Still further, some embodiments according to the teachings detailed herein include a processor and/or a computer that is in signal communication with a memory unit including such non-transitory computer readable medium, wherein the processor and/or computer can read the computer readable medium so as to implement or otherwise execute one or more of the method actions detailed herein and/or variations thereof While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method, comprising:

obtaining data based on a current and/or anticipated future wearing implementation of a hearing prosthesis;

adjusting a parameter of the hearing prosthesis based on the current or anticipated future wearing implementation of the hearing prosthesis; and evoking a hearing percept using the hearing prosthesis with the adjusted parameter, wherein the adjusted parameter is a feedback adaption speed of the hearing prosthesis.

2. The method of claim 1, wherein:

the current and/or anticipated future wearing implementation is an implementation where a microphone of the hearing prosthesis is at a different distance from a location of tissue stimulation relative to another wearing implementation.

3. The method of claim 1, wherein:

the current or anticipated future wearing implementation is an implementation where a microphone of the hearing prosthesis is located away from a head of the recipient.

4. The method of claim 1, wherein:

in the case of a current wearing implementation, the current wearing implementation is different from a previous wearing implementation; and in the case of a future wearing implementation, the future wearing implementation is different from a current wearing implementation.

5. A method, comprising:

evoking a hearing percept in a recipient via a hearing prosthesis set at a first setting and subsequently obtaining hearing prosthesis setting data corresponding to a current and/or anticipated future adjustable setting of the hearing prosthesis that influences performance of the hearing prosthesis, wherein the current and/or future anticipated setting is different from the first setting; and relocating at least a portion of the hearing prosthesis, relative to a body of the recipient of the hearing prosthesis, from a location of the portion of the hearing prosthesis where the hearing percept was evoked at the first setting, based on the obtained hearing prosthesis setting data.

6. The method of claim 5, wherein:

the current or anticipated future setting is a setting corresponding to an implementation of a feedback mitigation regime that is more aggressive in mitigating feedback relative to another feedback mitigation regime corresponding to the first setting; and the action of relocating at least a portion of the hearing prosthesis entails moving a microphone of the hearing prosthesis closer to a location of tissue stimulation by the hearing prosthesis that evokes a hearing percept.

7. The method of claim 5, wherein:

the current or anticipated future setting is a setting corresponding to an implementation of a feedback mitigation regime that is more aggressive in mitigating feedback relative to another feedback mitigation regime corresponding to the first setting; and the action of relocating at least a portion of the hearing prosthesis entails moving a microphone of the hearing prosthesis to a location where the feedback is greater than at the location from which the portion of the hearing prosthesis is relocated.

8. The method of claim 5, wherein:

in the case of a current setting, the first setting is more compatible with the location of the portion of the hearing prosthesis prior to the relocation than the current setting, and the current setting more compatible with the relocated portion of the hearing prosthesis than the previous setting; and in the case of a future setting, the first setting is more compatible with the location of the portion of the hearing prosthesis prior to the relocation than the future setting, and the future setting is more compatible with the relocated portion of the hearing prosthesis than the current setting.

9. The method of claim 5, wherein:

the current or anticipated future setting corresponds to a setting that results in an implementation that increases gain of the hearing prosthesis relative to the gain at the first setting; and the portion of the hearing prosthesis that is moved relative to the body of the recipient includes a microphone of the hearing prosthesis, wherein the movement of the portion entails moving the portion away from an implanted actuator of the hearing prosthesis that stimulates tissue.

10. The method of claim 5, wherein the current and/or future setting is a setting corresponding to an implementation of a map from among a plurality of applyable maps stored in the hearing prosthesis.

11. A device, comprising:

a hearing prosthesis configured such that an operating parameter thereof is adjustable to account for a change in a location of at least a portion of the sound capture device relative to a recipient of the hearing prosthesis, wherein the change in location changes a feedback path, and the operating parameter is a feedback adaption speed of the hearing prosthesis.

12. The device of claim 11, wherein:

the change in location changes a feedback path between the tissue stimulating component and the microphone.

13. The device of claim 11, wherein:

the hearing prosthesis includes at least a first feedback algorithm and a second feedback algorithm different from the first feedback algorithm, wherein the hearing prosthesis is configured to be adjusted to utilize the first feedback algorithm in a first scenario and to utilize the second feedback algorithm in the second scenario to account for a change in a location of at least a portion of the sound capture device relative to a recipient of the hearing prosthesis.

14. The device of claim 11, wherein:

the hearing prosthesis is a bone conduction device; and the hearing prosthesis is configured to at least one of:

allow a user to adjust a feedback control regime of the hearing prosthesis based on whether the hearing prosthesis is used as at least two of: (i) a passive transcutaneous bone conduction device magnetically coupled to an implanted component; (ii) a percutaneous bone conduction device; or (iii) a passive transcutaneous bone conduction device compressively retained to the recipient; or automatically adjust a feedback control regime of the hearing prosthesis based on whether the hearing prosthesis is used as at least two of: (i) a passive transcutaneous bone conduction device magnetically coupled to an implanted component; (ii) a percutaneous bone conduction device; or (iii) a passive transcutaneous bone conduction device compressively retained to the recipient.

15. The method of claim 5, wherein the current and/or future setting is a future setting.

16. The device of claim 12, wherein:

the hearing prosthesis is a bone conduction device.

17. The method of claim 5, wherein the action of relocated at least a portion of the hearing prosthesis includes moving a microphone of the hearing prosthesis further away from an actuator of the hearing prosthesis that evokes the hearing percept relative to a distance between the microphone and the actuator when the hearing percept was evoked.

18. The method of claim 1, further comprising:

obtaining data based on feedback.

19. The method of claim 1, wherein:

the obtained data is unrelated to feedback data; and the hearing percept evoked is based on ambient sound captured by the hearing prosthesis.

20. The device of claim 11, wherein:

the change in location is a change that maintains the sound capture device on a same side of a recipient of the hearing prosthesis; and the hearing prosthesis includes an implantable stimulator.

* * * * *